US009378743B2

(12) United States Patent
Riedmiller et al.

(10) Patent No.: US 9,378,743 B2
(45) Date of Patent: Jun. 28, 2016

(54) AUDIO ENCODING METHOD AND SYSTEM FOR GENERATING A UNIFIED BITSTREAM DECODABLE BY DECODERS IMPLEMENTING DIFFERENT DECODING PROTOCOLS

(75) Inventors: Jeffrey C. Riedmiller, Penngrove, CA (US); Farhad Farahani, Los Altos, CA (US); Michael Schug, Erlangen (DE); Regunathan Radhakrishnan, Foster City, CA (US); Mark S. Vinton, San Francisco, CA (US)

(73) Assignees: Dolby Laboratories Licensing Corp., San Francisco, CA (US); Dolby International AB, Amsterdam, Zuidoost (NL)

( * ) Notice: Subject to any disclaimer, the term of this patent is extended or adjusted under 35 U.S.C. 154(b) by 231 days.

(21) Appl. No.: 14/009,503

(22) PCT Filed: Apr. 5, 2012

(86) PCT No.: PCT/US2012/032252

§ 371 (c)(1),
(2), (4) Date: Mar. 18, 2014

(87) PCT Pub. No.: WO2012/138819

PCT Pub. Date: Oct. 11, 2012

(65) Prior Publication Data

US 2014/0358554 A1 Dec. 4, 2014

Related U.S. Application Data

(60) Provisional application No. 61/473,257, filed on Apr. 8, 2011, provisional application No. 61/473,762, filed on Apr. 9, 2011, provisional application No. 61/608,421, filed on Mar. 8, 2012.

(51) Int. Cl.

| | |
|---|---|
| ***G10L 19/008*** | (2013.01) |
| ***G10L 19/002*** | (2013.01) |
| ***G10L 19/16*** | (2013.01) |

(52) U.S. Cl.

CPC ..... *G10L 19/002* (2013.01); *G10L 19/167* (2013.01)

(58) Field of Classification Search

CPC ..... H04N 19/40; H04N 19/61; H04N 19/51; H04N 19/44; H04N 19/70; H04N 21/8543; H04N 19/176; H04N 21/8193; H04N 19/132; H04N 19/172; H04N 19/42; H04N 19/12

USPC ..... 704/500–504; 370/276, 280–281, 297

See application file for complete search history.

(56) References Cited

U.S. PATENT DOCUMENTS 5,663,726 A * 9/1997 Bakhmutsky ..... H03M 7/425 341/63

2007/0002054 A1 1/2007 Bronstein (Continued)

FOREIGN PATENT DOCUMENTS

| | | |
|---|---|---|
| CN | 1266335 | 9/2000 |
| DE | 10102159 | 8/2002 |

(Continued)

OTHER PUBLICATIONS

Liu, Chi-Min, et al. "Bit Reservoir Design for HE-AAC" AES presented at the 118th Convention, May 28-31, 2005, Barcelona, Spain.

(Continued)

*Primary Examiner* — Marivelisse Santiago Cordero
*Assistant Examiner* — Stephen Brinich

(57) ABSTRACT

In a class of embodiments, an audio encoding system (typically, a perceptual encoding system that is configured to generate a single ("unified") bitstream that is compatible with (i.e., decodable by) a first decoder configured to decode audio data encoded in accordance with a first encoding protocol (e.g., the multichannel Dolby Digital Plus, or DD+, protocol) and a second decoder configured to decode audio data encoded in accordance with a second encoding protocol (e.g., the stereo AAC, HE AAC v1, or HE AAC v2 protocol). The unified bitstream can include both encoded data (e.g., bursts of data) decodable by the first decoder (and ignored by the second decoder) and encoded data (e.g., other bursts of data) decodable by the second decoder (and ignored by the first decoder). In effect, the second encoding format is hidden within the unified bitstream when the bitstream is decoded by the first decoder, and the first encoding format is hidden within the unified bitstream when the bitstream is decoded by the second decoder. The format of the unified bitstream generated in accordance with the invention may eliminate the need for transcoding elements throughout an entire media chain and/or ecosystem. Other aspects of the invention are an encoding method performed by any embodiment of the inventive encoder, a decoding method performed by any embodiment of the inventive decoder, and a computer readable medium (e.g., disc) which stores code for implementing any embodiment of the inventive method.

20 Claims, 13 Drawing Sheets

(56) References Cited

U.S. PATENT DOCUMENTS

| | | | | |
|---|---|---|---|---|
| 2009/0106288 | A1 | 4/2009 | Yang | |
| 2011/0032985 | A1* | 2/2011 | Jang | H04N 21/4348 375/240.02 |

FOREIGN PATENT DOCUMENTS

| | | |
|---|---|---|
| EP | 1553745 | 7/2005 |
| EP | 1873780 | 1/2008 |
| TW | I241558 | 10/2005 |
| TW | 200828268 | 7/2008 |
| WO | 01/87015 | 11/2001 |
| WO | 02/091361 | 11/2002 |

OTHER PUBLICATIONS

ATSC Advanced Television Systems Committee, ATSC Standard: Digital Audio Compression (AC-3, E-AC-3), Doc. A/52:2012, Dec. 17, 2012.

ISO/IEC 14496-3 "Information Technology—Coding of Audio Visual Objects—Part 3: Audio" published on Aug. 26, 2009.

* cited by examiner

"Hyperframe" Structure <ADTS Type> v1

Applicable to: iOS devices -> iPhone, iPad AND MPEG Transport Stream

1 "Hyperframe" contains 4 DD+ & 3 HE-AAC frames representing a time window of 128msec

AUDIO ENCODING METHOD AND SYSTEM FOR GENERATING A UNIFIED BITSTREAM DECODABLE BY DECODERS IMPLEMENTING DIFFERENT DECODING PROTOCOLS

CROSS-REFERENCE TO RELATED APPLICATIONS

This application claims priority to U.S. Patent Provisional Application Nos. 61/473,257, filed 8 Apr. 2011, 61/473,762, filed 9 Apr. 2011, and 61/608,421, filed 8 Mar. 2012, all hereby incorporated by reference in each entireties.

BACKGROUND OF THE INVENTION

1. Field of the Invention

The invention relates to audio encoding systems (e.g., perceptual encoding systems) and to encoding methods implemented thereby. In a class of embodiments, the invention relates to an audio encoding system configured to generate a single ("unified") bitstream that is simultaneously compatible with (i.e., decodable by) a first decoder configured to decode audio data encoded in accordance with a first encoding protocol (e.g., multichannel Dolby Digital Plus (E AC-3), or DD+, protocol) and a second decoder configured to decode audio data encoded in accordance with a second encoding protocol (e.g., the AAC, HE AAC v1, or HE AAC v2 protocol).

2. Background of the Invention

Throughout this disclosure including in the claims, the expression performing an operation (e.g., filtering or transforming) "on" signals or data is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem configured to encode data may be referred to as an encoding system (or encoder), and a system including such an encoding subsystem may also be referred to as an encoding system (or encoder).

The expression "encoding protocol" is used herein to denote a set of rules in accordance with which a specific type of encoding is performed. Typically, the rules are set forth in a specification that defines the specific type of encoding.

The expression "decoding protocol" is used herein to denote a set of rules in accordance with which encoded data are decoded, where the encoded data have been encoded in accordance with a specific encoding protocol. Typically, the rules are set forth in a specification that also defines the specific encoding protocol.

Throughout this disclosure including in the claims, the expression "perceptual encoding system" (for encoding audio data determining an audio program that can be rendered by conversion into one or more speaker feeds and conversion of the speaker feed(s) to sound using at least one speaker, said sound having a perceived quality to a human listener) denotes a system configured to compress the audio data in such a manner that, when the inverse of the compression is performed on the compressed data and the resulting decoded data are rendered using the at least one speaker, the resulting sound is perceived by the listener without significant loss in perceived quality. A perceptual encoding system optionally also performs at least one other operation (e.g., upmixing or downmixing) on the audio data in addition to the compression.

Perceptual encoding systems are commonly used to compress (and typically also to downmix or upmix) audio data. Examples of such systems that are in widespread use include the multichannel Dolby Digital Plus ("DD+") system (compliant with the well-known Enhanced AC-3, or "E AC-3," digital audio compression protocol adopted by the Advanced Television Systems Committee, Inc.), the MPEG AAC system (compliant with the well-known Advanced Audio Coding or "AAC" audio compression protocol), the HE AAC system (compliant with the well-known MPEG High Efficiency Advanced Audio Coding v1, or "HE AAC v1" audio compression protocol, or the well-known High Efficiency Advanced Audio Coding v2, or "HE AAC v2" audio compression protocol), and the Dolby Pulse system (operable to output a bitstream including DD+(or Dolby Digital) metadata with HE AAC v2 encoded audio, so that an appropriate decoder can extract the metadata from the bitstream and decode the HE AAC v2 audio).

A conventional decoder (known as the Dolby® Multistream Decoder) is capable of decoding either a DD+ encoded bitstream or a Dolby Pulse encoded bitstream. However, this decoder is implemented to be compliant with both the DD+ decoding protocol and the HE AAC v2 decoding protocol, and to extract DD+ (or Dolby Digital) metadata from a Dolby Pulse bitstream. However, a conventional DD+ decoder (compliant with the DD+ decoding protocol but not the HE AAC v2 decoding protocol) could not decode a Dolby Pulse encoded bitstream or a conventional HE AAC v2 encoded bitstream. Nor could a conventional HE AAC v2 decoder (compliant only with the HE AAC v2 decoding protocol but not with the DD+ decoding protocol, and not configured to extract DD+ (or Dolby Digital) metadata from a Dolby Pulse bitstream) decode a DD+ encoded bitstream. Nor could a conventional Dolby Pulse decoder (compliant with the HE AAC v2 decoding protocol and configured to extract DD+ (or Dolby Digital) metadata from a Dolby Pulse bitstream, but not compliant with the DD+ decoding protocol) decode a DD+ bitstream.

It would be desirable to encode audio data in a manner that generates a single bitstream of encoded data that is compatible with (in the sense of being decodable by either) a first conventional decoder configured to decode audio data encoded in accordance with a first conventional encoding protocol (e.g., the DD+ protocol) and a second conventional decoder configured to decode audio data encoded in accordance with a second encoding protocol (e.g., the AAC or HE AAC v2 protocol).

In typical embodiments, the inventive encoder is a key element of a cross-platform audio coding system that efficiently unifies two independent perceptual audio encoding systems into a single encoding system and bitstream format. For example, some embodiments of the inventive encoder combine a DD+ (E AC-3) encoding system and a Dolby Pulse (HE-AAC) encoding system into a single, powerful and efficient perceptual audio encoding system and format, capable of generating a single bitstream that is decodable by either a conventional DD+ decoder or a conventional HE AAC v2 (or HE AAC v1, or AAC) decoder. The bitstream that is output from such embodiments of the inventive encoder is thus compatible with the majority of deployed media playback devices found throughout the world regardless of device type (e.g., AVRs, STBs, Digital Media Adapters, Mobile Phones, Portable Media Players, PCs, etc.).

BRIEF DESCRIPTION OF THE INVENTION

In a class of embodiments, the invention is an audio encoding system (typically, a perceptual encoding system that is configured to generate a single ("unified") bitstream that is compatible with (i.e., decodable by) a first decoder configured to decode audio data encoded in accordance with a first encoding protocol (e.g., the multichannel Dolby Digital Plus (E AC-3), or DD+, protocol) and a second decoder configured to decode audio data encoded in accordance with a second encoding protocol (e.g., the MPEG AAC, HE AAC v1, or HE AAC v2 protocol). The bitstream can include both encoded data (e.g., bursts of data) decodable by the first decoder (and ignored by the second decoder) and encoded data (e.g., other bursts of data) decodable by the second decoder (and ignored by the first decoder). In effect, the second encoding format is hidden within the unified bitstream when the bitstream is decoded by the first decoder, and the first encoding format is hidden within the unified bitstream when the bitstream is decoded by the second decoder. Moreover, the invention is not dependent on the first and second decoders being simultaneously present within a system and/or device. Hence, a device or system containing only a single decoder that is compatible with only one of the unified bitstream's protocols is supported by the invention. In this case, the unknown/unsupported portion(s) of the unified bitstream will be ignored by the decoder. The format of the unified bitstream generated in accordance with the invention may eliminate the need for transcoding elements throughout an entire media chain and/or ecosystem.

In typical embodiments, the inventive encoder is a key element of a cross-platform audio coding system that efficiently unifies two or more independent perceptual audio encoding systems (each implementing a different encoding protocol) into a single system which outputs a single bitstream having a unified format, such that the bitstream is decodable by each of two or more decoders (each decoder configured to decode audio data encoded in accordance with a different one of the encoding protocols). As an example, Dolby Digital Plus (E AC-3) and Dolby Pulse (HE-AAC v2) systems can be combined in accordance with a class of embodiments of the invention into a single powerful and efficient perceptual audio encoding system and format that is compatible with the majority of deployed media playback devices found throughout the world regardless of device type (e.g., AVRs, STBs, Digital Media Adapters, Mobile Phones, Portable Media Players, PCs, etc.). One of the many benefits of typical embodiments of the invention is the ability for a coded audio bitstream (decodable by two or more decoders each configured to decode audio data encoded in accordance with a different encoding protocol) to be carried over a range (e.g., a wide range) of media delivery systems, where each of the delivery systems conventionally (i.e., prior to the present invention) only supports data encoded in accordance with one of the encoding protocols.

Conventional perceptual audio encoding systems (e.g., Dolby Digital Plus, MPEG AAC, MPEG HE-AAC, MPEG Layer 3, MPEG Layer 2 and others) typically provide standardized bitstream elements to enable the transport of additional (arbitrary) data within the bitstream itself. This additional (arbitrary) data is skipped (i.e., ignored) during decoding of the encoded audio included in the bitstream, but may be used for a purpose other than decoding. Different conventional audio coding standards express these additional data fields using unique nomenclature (expressed in their associated standards documents). In the present disclosure, examples of bitstream elements of this general type are referred to as: auxiliary data, skip fields, data stream elements, fill elements, or ancillary data, and the expression "auxiliary data" is always used as a generic expression encompassing any/all of these examples.

An exemplary data channel (enabled via "auxiliary" bitstream elements of a first encoding protocol) of a combined bitstream (generated in accordance with an embodiment of the invention) would carry a second (independent) audio bitstream (encoded in accordance with a second encoding protocol), split into N-sample blocks and multiplexed into the "auxiliary data" fields of a first bitstream. The first bitstream is still decodable by an appropriate (complement) decoder. In addition, the "auxiliary data" of the first bitstream could be read out, recombined into the second bitstream and decoded by a decoder supporting the second bitstream's syntax.

Obviously the same is possible with the roles of the first and second bitstreams reversed, that is, to multiplex blocks of data of a first bitstream into the "auxiliary data" of a second bitstream.

In some embodiments, the inventive encoding system is configured to combine a first bitstream of encoded audio data (encoded in accordance with a first protocol) with a second bitstream of encoded audio data (encoded in accordance with a second protocol) by inserting (multiplexing) the second bitstream into auxiliary data locations of the first bitstream in such a way that the first bitstream is auxiliary data of the second bitstream and the second bitstream is auxiliary data of the first bitstream. The resulting combined bitstream is (simultaneously) a valid bitstream for a first audio codec bitstream format ("format 1"), and a valid bitstream for a second audio codec bitstream format ("format 2"). When the unified bitstream is fed to a decoder configured to decode data encoded in format 1 ("decoder 1"), the audio (encoded in accordance with format 1) contained in the bitstream will be decoded, and if the same bitstream is provided (e.g., simultaneously provided) to another decoder configured to decode data encoded in format 2 ("decoder 2"), the audio (encoded in accordance with format 2) contained within the bitstream will be decoded Importantly, no demultiplexing, extracting and/or recombining of the original first or second bitstream is necessary. A preferred embodiment of the invention combines a 5.1 channel DD+ (Dolby Digital Plus (E AC-3)) bitstream with a two-channel MPEG HE-AAC bitstream into a single unified bitstream. However the present invention is not limited to these specific formats and channel modes.

In a class of embodiments, the inventive encoder includes two encoding subsystems (each of these subsystems configured to encode audio data in accordance with a different protocol) and is configured to combine the outputs of the subsystems to generate a dual-format (unified) bitstream. In this class of embodiments, the encoder is configured to operate with a shared or common bitpool (input bits that are shared between the encoding subsystems) and to distribute the available bits (in the shared bitpool) between the encoding subsystems in order to optimize the overall audio quality of the unified bitstream (e.g., to encode more or less of the available bits using one of the encoding subsystems, and the rest of the available bits using the other one of the encoding subsystems, depending on results of statistical analysis of the shared bitpool, and to multiplex the outputs of the two encoding subsystems together to generate the unified bitstream). In some such embodiments, the encoder is configured to operate on common bitpool by encoding some of the bits thereof as HE-AAC data and the rest as DD+ data (or to encode the entire common bitpool as HE-AAC data or DD+ data), and the encoder implements a statistical multiplexing operation to optimize the bit allocation between its DD+ and HE-AAC encoding subsystems to produce an optimized output, unified bitstream. To reduce the simultaneous demand (by the two encoding subsystems of an encoder in this class) for bits from the common pool, the two encoding subsystems can be de-synchronized by N audio samples and/or blocks (utilizing an adaptive delay), for example, when input bits indicative of a complex or difficult audio passage and/or scene are being encoded. In some implementations, the shared bitpool provides a mechanism for ensuring that groups of data frames (of the unified output bitstream) represent a fixed number of input audio samples or a specific number of input bits (to simplify downstream processes such as bitstream packetization and multiplexing with video). The block labeled "common bit pool/statistical mux" in FIG. 5 is an exemplary element (of an encoder in this class) configured to distribute bits from a shared bitpool between two encoding subsystems (an E AC-3 encoding subsystem on the right side of FIG. 5, and an HE AAC v1 encoding subsystem on the left side of FIG. 5), preferably with knowledge of the input bit rate and the maximum hyperframe length of the unified output bitstream, by determining how many bits of input data (indicated by frequency-domain coefficients output from the Time-to-Frequency domain Transform stage of the E AC-3 encoding subsystem) to assign to each quantized mantissa of the E AC-3 encoded frequency-domain coefficients, and how many bits of input data (indicated by frequency-domain coefficients output from the "MDCT" (modified discrete cosine transform) stage of the HE AAC v1 encoding subsystem) to assign to the quantized HE AAC v1 code words output from the HE AAC v1 subsystem. In some implementations, the embodiment of FIG. 5 (or FIG. 6, 7, or 8) is configured to allocate available bits from the shared bitpool between the two encoding subsystems in accordance with a shared bit budget, and/or to allocate the available bits from the shared bitpool in a manner dependent on at least one of perceptual complexity and entropy of the audio data in the shared bitpool.

In contrast with the FIG. 5 system, a conventional E AC-3 encoder would include a bit allocation element configured to determine how many bits of input data to assign to each quantized mantissa of the E AC-3 encoded frequency-domain coefficients (generated by the E AC-3 encoder) in a manner independent of consideration of multiplexing of the E AC-3 encoded data into a unified bitstream, and a conventional HE AAC v1 encoder would include a bit allocation element configured to determine how many bits of input data to assign to each quantized HE AAC v1 code word (generated by the HE AAC v1 encoder) in a manner independent of consideration of multiplexing of the HE AAC v1 encoded data into a unified bitstream. Preferably, the bit rate of the input shared bitpool, and the maximum hyperframe length (of the output, combined bit stream) are known, and are used to optimize the bit allocation performed between the two (e.g., DD+ and HEAAC) encoding subsystems of the inventive encoder to produce an optimized output, combined bit stream.

Preferably, a first decoder capable of supporting a unified bitstream (generated in accordance with a typical embodiment of the invention to include first encoded audio in a first audio codec bitstream format, and also second encoded audio in a second audio codec bitstream format) can decode the first encoded audio to generate first audio and can also directly control the playback loudness and dynamic range (or otherwise adapt processing) of the first audio while only relying on (e.g., in accordance with) metadata (e.g., loudness and dynamic range information) included in the unified bitstream, and a second decoder capable of supporting the unified bitstream can decode the second encoded audio to generate second audio and can also directly control the playback loudness and dynamic range (or otherwise adapt processing) of the second audio while only relying on (e.g., in accordance with) metadata (e.g., loudness and dynamic range information) included in the unified bitstream. For example, the metadata is extracted from the unified bitstream and used by the relevant decoder to adapt processing according to the metadata. Preferably, the efficiency of the unified system and bitstream format is further improved by transmitting such metadata in a singular fashion and yet in a way that either decoder could process it.

Some embodiments of the invention provide an efficient method for carrying additional payload (e.g., spatial coding information of a type used in MPEG Surround processing) in singular fashion in a unified bitstream (e.g., including only 1 or 2 channels of encoded audio data), with the additional payload being directly applicable to each stream of decoded audio generated by decoding bits of the unified bitstream.

The unified bitstream generated by typical embodiments of the invention also supports de-interleaving (e.g., for applications requiring a scalable data rate and/or endpoint device scalability). In some embodiments, the unified bitstream can be de-interleaved (e.g., by the encoder which generates said unified bitstream, where the encoder is configured to perform the de-interleaving) to generate a first bitstream (including audio data encoded in accordance with a first encoding protocol) and a second bitstream (including audio data encoded in accordance with a second encoding protocol), so that each of the first bitstream and the second bitstream is directly compatible with a decoder configured to decode data encoded in accordance with the respective encoding protocol. In other embodiments, the unified bitstream must undergo an additional processing step during the de-interleaving process for one of the de-interleaved bitstreams to become compatible with its respective decoder. To simplify scalability (de-interleaving), the unified bitstream can carry additional error detection data and/or information (e.g., at least one of error detection data, error detection information, CRCs, and HASH values) that is or are applicable to each of the de-interleaved bitstream types. This eliminates the need for additional processing to re-compute the error detection data and/or information during the de-interleaving process.

Some embodiments of the inventive encoder implement one or more of the following features: generation of a unified bitstream comprising hyperframes of encoded data encoded in accordance with two or more encoding protocols (e.g., each hyperframe consists of X frames of encoded audio data encoded in accordance with one encoding protocol, multiplexed with Y frames of encoded audio data encoded in accordance with another encoding protocol, so that the hyperframe includes X+Y frames of encoded audio data); transcoding (e.g., the inventive encoder includes an encoding subsystem coupled and configured to re-encode (e.g., in accordance with a different encoding protocol) decoded data that have been generated by decoding bits from a unified bitstream); means for generating or processing BSID (bit stream identification) or HASH (via DSE) value(s); CRC recalculation; and tying of de-synchronized stream generators to a MPEG 2/4 System timing model to account for latency shifts.

In one class of embodiments (e.g., that to be described with reference to FIG. 2 or 3), the inventive encoder generates a unified bitstream including HE-AAC data (data encoded in accordance with an HE-AAC protocol) as "auxiliary data" of a DD+ stream, and DD+ data (data encoded in accordance with the DD+ protocol) as "data stream" elements (another type of auxiliary data) of an HE-AAC stream. The HE-AAC data can be decoded by a conventional HE-AAC decoder (which ignores the DD+ data), and the DD+ data can be decoded by a conventional DD+ decoder (which ignores the HE-AAC data). The unified bitstream generated by each of these embodiments is subject to an MPEG limitation on maximum number of bits per frame per second (due to the MPEG maximum combined bit rate of 288 kbits/sec for 48 kHz HE-AAC 2 channel, or in the case of 48 kHz AAC-LC, the maximum combined bit rate of 576 kbits/sec)). However, the unified bitstream generated by each of these embodiments does not require any special decoder element to distinguish the HE-AAC data from DD+ data from each other (either a conventional DD+ decoder or a conventional HE-AAC decoder could do so).

In another class of embodiments, the inventive encoder generates a unified bitstream including DD+ data (data encoded in accordance with the DD+ protocol) sent as an independent substream of a DD+ encoded data stream (which a DD+ decoder will decode), and HE-AAC data (data encoded in accordance with an HE-AAC protocol) sent as a second (independent or dependent) DD+ substream of a DD+ encoded data stream (one which a DD+ decoder will ignore). This embodiment is preferable to the first embodiment since it is not subject to the MPEG limitation on maximum number of bits per frame per second. However, it would require any that a conventional HE-AAC decoder be equipped with a simple additional element to separate the HE-AAC data from the unified bitstream (i.e., an element capable of recognizing which bursts of the unified bitstream belong to the "second" DD+ substream, which is the substream including the HE-AAC data) for decoding by the conventional HE-AAC decoder.

Other aspects of the invention are an encoding method performed by any embodiment of the inventive encoder (e.g., a method which the encoder is programmed or otherwise configured to perform), a decoding method performed by any embodiment of the inventive decoder (e.g., a method which the decoder is programmed or otherwise configured to perform), and a computer readable medium (e.g., a disc) which stores code for implementing any embodiment of the inventive method.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system and method will be described with reference to FIGS. 1-9.

Figure 1:
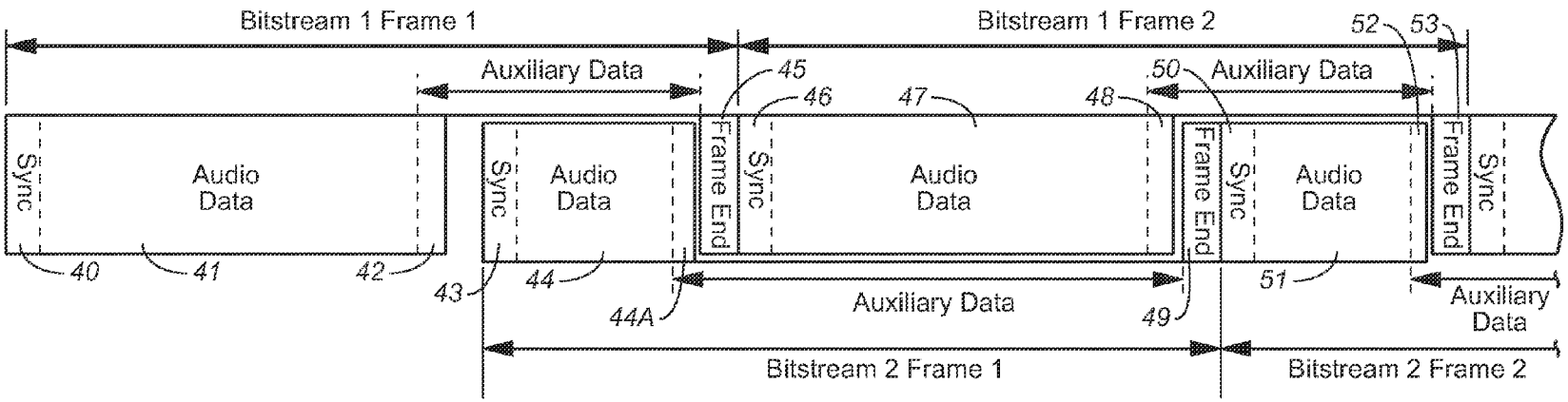
FIG. 1 is a diagram of a portion of a bitstream generated by an embodiment of the inventive encoding system. The bitstream includes first encoded audio data (encoded in accordance with a first encoding protocol) and second encoded audio data (encoded in accordance with a second encoding protocol), and can be decoded either by a first decoder (which decodes the first encoded audio data and ignores the second encoded audio data) or by a second decoder (which decodes the second encoded audio data and ignores the first encoded audio data).

FIG. 1 is a diagram of a portion of a unified bitstream generated by an embodiment of the inventive encoding system. The bitstream includes first encoded audio data 41 and 47 (encoded in accordance with a first encoding protocol) and second encoded audio data 44 and 51 (encoded in accordance with a second encoding protocol), and can be decoded either by a first decoder (which decodes the first encoded audio data and ignores the second encoded audio data) or by a second decoder (which decodes the second encoded audio data and ignores the first encoded audio data). The encoder which generates the FIG. 1 bitstream inserts sync bits 40 into the bitstream just before audio data 41, and control bits 42 into the bitstream just after audio data 41, and frame end bits 45 into the bitstream after bits 44A. The first decoder would recognize sync bits 40 as the start of a frame ("frame 1" in FIG. 1) of data (encoded in accordance with the first protocol) to be decoded, and control bits 42 as the start of auxiliary data (of the frame) to be ignored, and frame end bits 45 as the end of the frame. The encoder which generates the FIG. 1 bitstream also inserts sync bits 46 into the bitstream just before audio data 47, and control bits 48 into the bitstream just after audio data 47, and frame end bits 53 into the bitstream after bits 52. The first decoder would recognize sync bits 46 as the start of another frame ("frame 2" in FIG. 1) of data (encoded in accordance with the first protocol) to be decoded, and control bits 48 as the start of auxiliary data (of the frame) to be ignored, and frame end bits 53 as the end of the frame.

The encoder which generates the FIG. 1 bitstream inserts sync bits 43 into the bitstream just before audio data 44, and control bits 44A into the bitstream just after audio data 44, and frame end bits 49 into the bitstream after bits 48. The second decoder would recognize sync bits 43 as the start of a frame ("frame 1" in FIG. 1) of data (encoded in accordance with the second protocol) to be decoded (and would ignore the bits preceding sync bits 43), and would recognize control bits 44A as the start of auxiliary data (of the frame) to be ignored, and frame end bits 49 as the end of the frame. The encoder which generates the FIG. 1 bitstream also inserts sync bits 50 into the bitstream just before audio data 51, and control bits 52 into the bitstream just after audio data 51. The second decoder would recognize sync bits 50 as the start of another frame ("frame 2" in FIG. 1) of data (encoded in accordance with the second protocol) to be decoded, and control bits 52 as the start of auxiliary data (of the frame) to be ignored.

Figure 2:
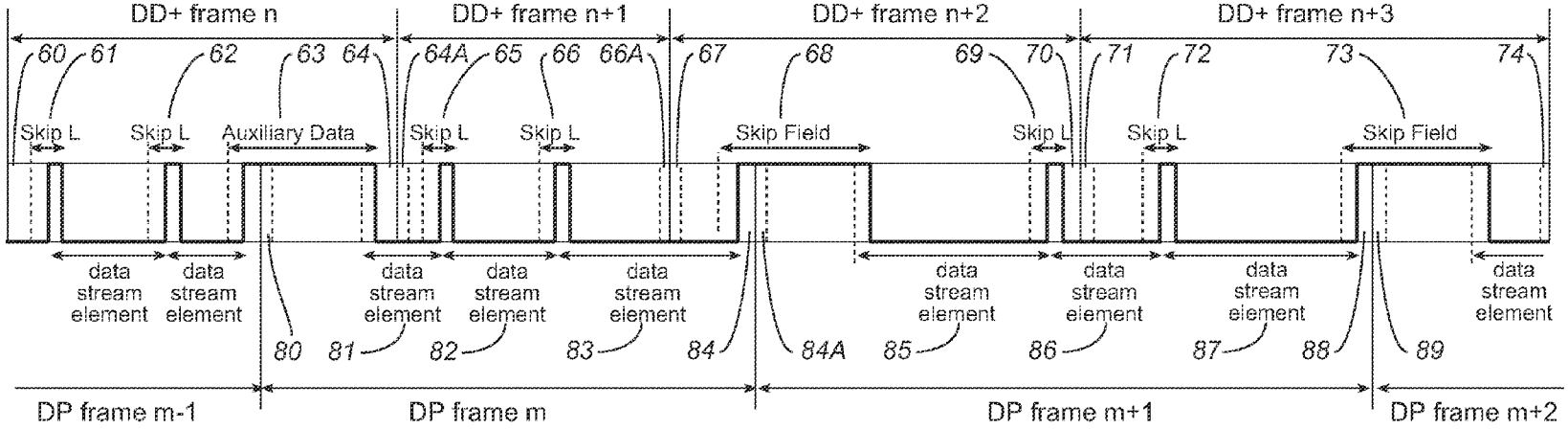
FIG. 2 is a diagram of a portion of a bitstream generated by another embodiment of the inventive encoding system. The bitstream includes first encoded audio data (encoded in accordance with a first encoding protocol) and second encoded audio data (encoded in accordance with a second encoding protocol), and can be decoded either by a first decoder (which decodes the first encoded audio data and ignores the second encoded audio data) or by a second decoder (which decodes the second encoded audio data and ignores the first encoded audio data).

FIG. 2 is a diagram of a portion of a bitstream generated by another embodiment of the inventive encoding system. The bitstream includes first encoded audio data (encoded in accordance with a first encoding protocol, namely the DD+ protocol) and second encoded audio data (encoded in accordance with a second encoding protocol, namely HE AAC v2 encoded audio generated in accordance with the Dolby Pulse protocol), and can be decoded either by a first decoder (which decodes the first encoded audio data and ignores the second encoded audio data) or by a second decoder (which decodes the second encoded audio data and ignores the first encoded audio data). The encoder which generates the FIG. 2 bitstream inserts the following sequence of bits into the bitstream: sync bits 60 just before a burst of DD+ encoded audio data, control bits just after this audio data to indicate that a DD+ decoder should skip bits 61, another burst of DD+ encoded audio data, control bits just after this audio data to indicate that a DD+ decoder should skip bits 62, another burst of DD+ encoded audio data, control bits just after this audio data to indicate that a DD+ decoder should skip bits 63, and frame end bits 44 after bits 63. The first decoder would recognize sync bits 60 as the start of a frame ("frame n" in FIG. 2) of data (encoded in accordance with the DD+ protocol) to be decoded, and would ignore bits 61, 62, and 63, and would recognize frame end bits 64 as the end of the frame. The encoder which generates the FIG. 2 bitstream also inserts the following sequence of bits into the bitstream: sync bits 64A just before a burst of DD+ encoded audio data, control bits just after this audio data to indicate that a DD+ decoder should skip bits 65, another burst of DD+ encoded audio data, control bits just after this audio data to indicate that a DD+ decoder should skip bits 66, another burst of DD+ encoded audio data, and frame end bits 66A after this audio data. The first decoder would recognize sync bits 64A as the start of a frame ("frame n+1" in FIG. 2) of data (encoded in accordance with the DD+ protocol) to be decoded, and would ignore bits 65, 66, and 66A, and would recognize frame end bits 64A as the end of the frame. The encoder also inserts the following sequence of bits into the bitstream: sync bits 67 just before a burst of DD+ encoded audio data, control bits just after this audio data to indicate that a DD+ decoder should skip bits 68, another burst of DD+ encoded audio data, control bits just after this audio data to indicate that a DD+ decoder should skip bits 69, and frame end bits 70 after bits 66. The first decoder would recognize sync bits 67 as the start of a frame ("frame n+2" in FIG. 2) of data (encoded in accordance with the DD+ protocol) to be decoded, and would ignore bits 68 and 69, and would recognize frame end bits 70 as the end of the frame. The encoder which generates the FIG. 2 bitstream also inserts the following sequence of bits into the bitstream: sync bits 71 just before a burst of DD+ encoded audio data, control bits just after this audio data to indicate that a DD+ decoder should skip bits 72, another burst of DD+ encoded audio data, control bits just after this audio data to indicate that a DD+ decoder should skip bits 73, another burst of DD+ encoded audio data, and frame end bits 74 after this audio data. The first decoder would recognize sync bits 71 as the start of a frame ("frame n+3" in FIG. 2) of data (encoded in accordance with the DD+ protocol) to be decoded, and would ignore bits 72 and 73, and would recognize frame end bits 74 as the end of the frame.

The encoder which generates the FIG. 2 bitstream inserts the following sequence of bits into the bitstream: sync bits 80 just before a burst of HE AAC v2 encoded audio data, control bits just after this audio data to indicate that an HE AAC v2 decoder should skip bits 81 (i.e., treat it as a data stream element to be ignored), control bits just after bits 81 to indicate that an HE AAC v2 decoder should skip bits 82, and control bits just after bits 82 to indicate that an HE AAC v2 decoder should skip bits 83, and frame end bits 44 after bits 83. The second decoder would recognize sync bits 80 as the start of a frame ("frame m" in FIG. 2) of data (encoded in accordance with the HE AAC v2 protocol) to be decoded, and would ignore bits 81, 82, and 83, and would recognize frame end bits 84 as the end of the frame. The encoder which generates the FIG. 2 bitstream also inserts the following sequence of bits into the bitstream: sync bits 84A just before a burst of HE AAC v2 encoded audio data, control bits just after this audio data to indicate that an HE AAC v2 decoder should skip bits 85 (i.e., treat it as a data stream element to be ignored), control bits just after bits 85 to indicate that an HE AAC v2 decoder should skip bits 86, and control bits just after bits 86 to indicate that an HE AAC v2 decoder should skip bits 87, and frame end bits 88 after bits 87. The second decoder would recognize sync bits 84A as the start of a frame ("frame m+1" in FIG. 2) of data (encoded in accordance with the HE AAC v2 protocol) to be decoded, and would ignore bits 85, 86, and 87, and would recognize frame end bits 88 as the end of the frame.

The FIG. 2 bitstream is thus indicative of a sequence of hyperframes of encoded audio data, each hyperframe including seven frames of encoded audio data: a first frame of DD+ encoded data (e.g., frame "n" of FIG. 2), a first frame of HE AAC encoded data (e.g., frame "m" of FIG. 2), a second frame of DD+ encoded data (e.g., frame "n+1" of FIG. 2), a second frame of HE AAC encoded data, a third frame of DD+ encoded data, a third frame of HE AAC encoded data, and a fourth frame of DD+ encoded data.

Figure 3:
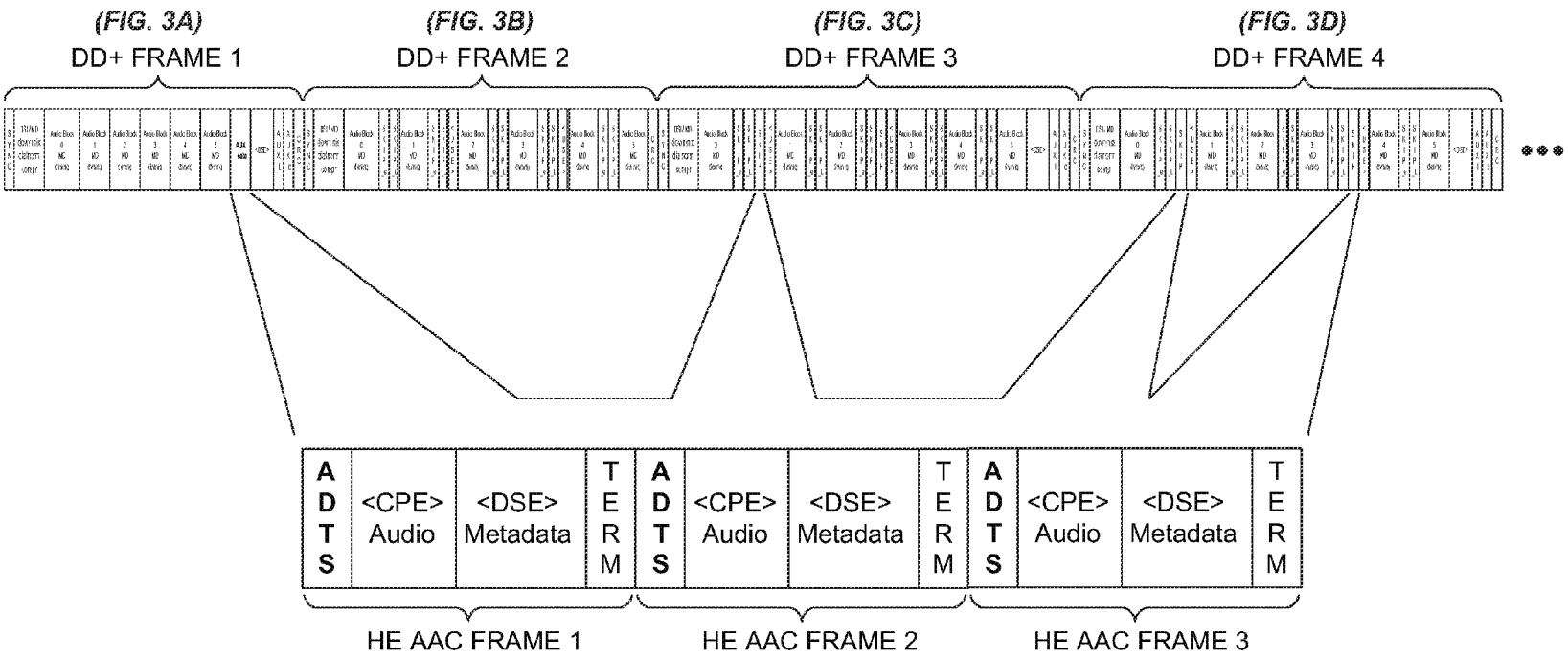
FIG. 3 is a diagram of a portion of a bitstream generated by another embodiment of the inventive encoding system. The bitstream includes first encoded audio data (encoded in accordance with a first encoding protocol) (FIG. 3A) and second encoded audio data (encoded in accordance with a second encoding protocol) (FIG. 3B), and can be decoded either by a first decoder (which decodes the first encoded audio data and ignores the second encoded audio data) (FIG. 3C) or by a second decoder (which decodes the second encoded audio data and ignores the first encoded audio data) (FIG. 3D).
Figure 3A:
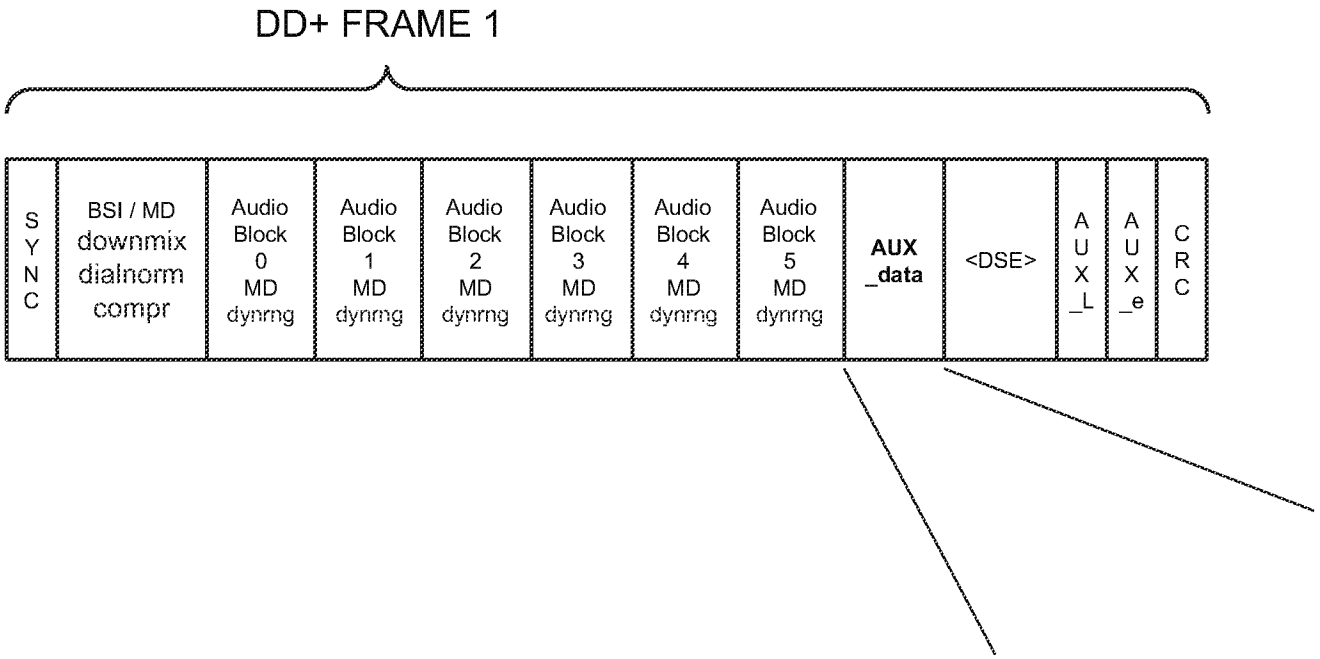
Figure 3B:
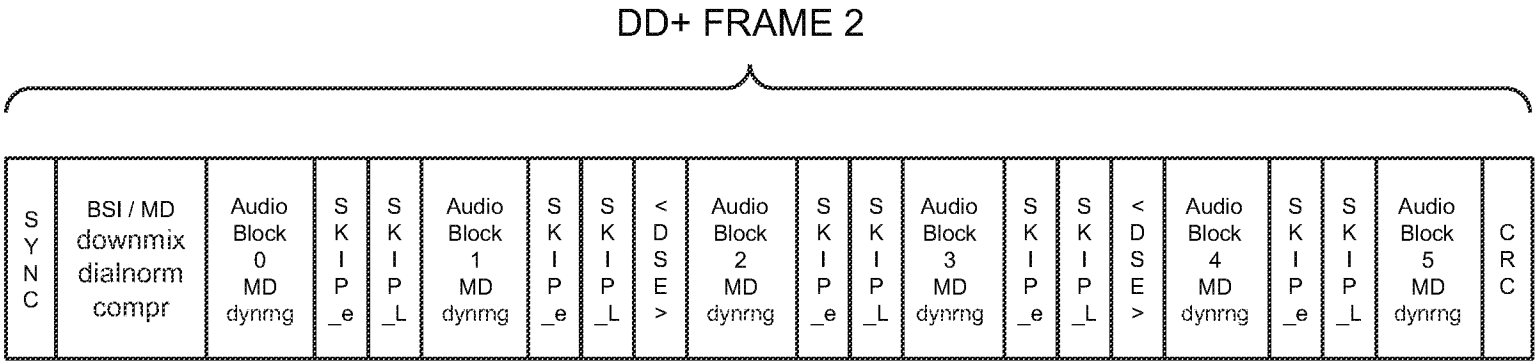
Figure 3C:
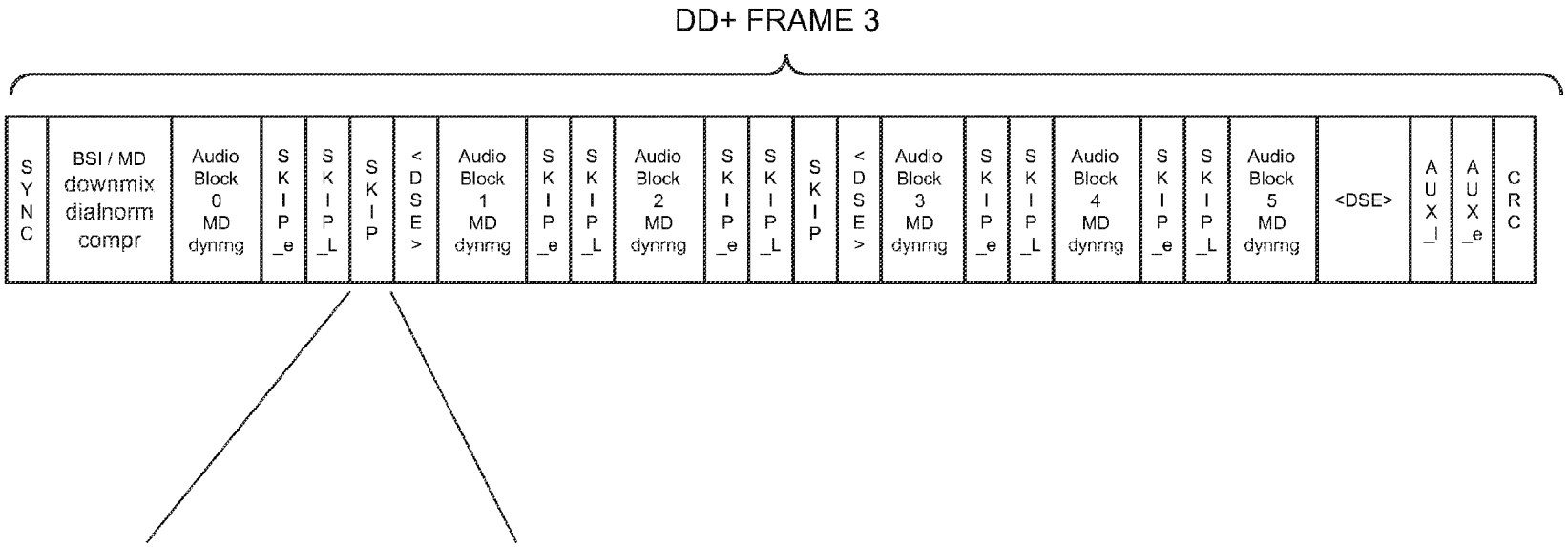
Figure 3D:
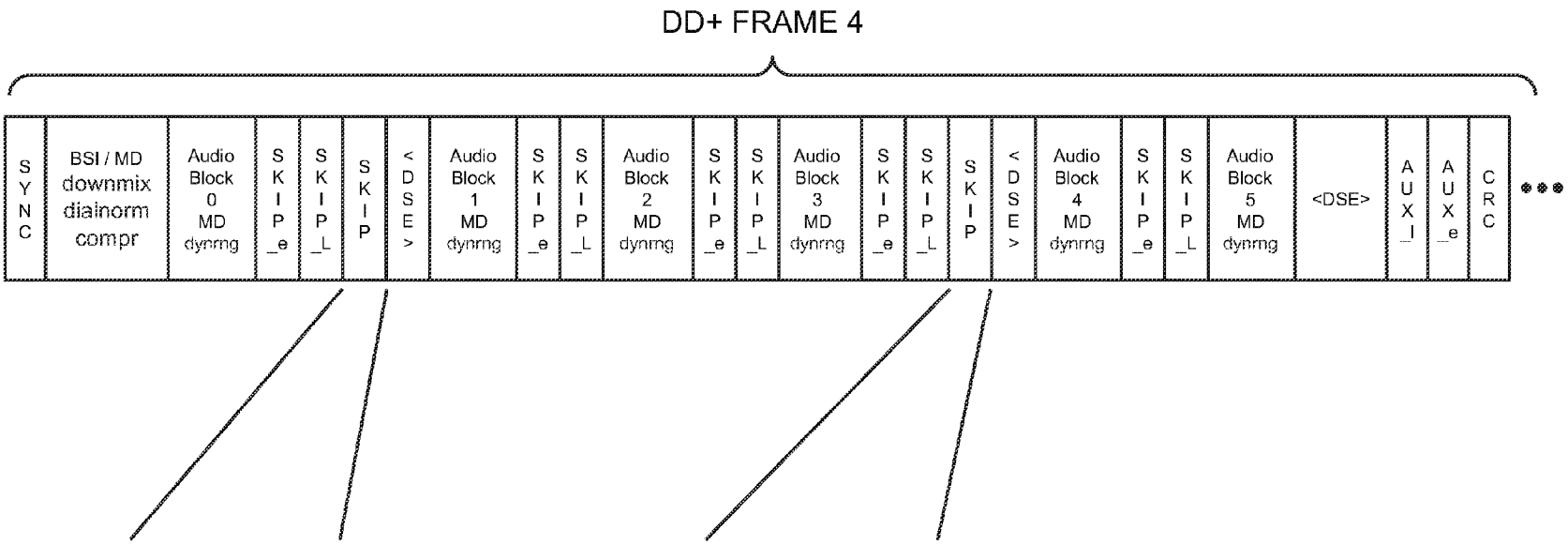

FIG. 3 is a diagram of a portion of a bitstream generated by another embodiment of the inventive encoding system. The bitstream includes "first encoded audio data" encoded in accordance with a first encoding protocol (the DD+ protocol) and "second encoded audio data" encoded in accordance with a second encoding protocol (HE AAC encoded audio generated in accordance with the Dolby Pulse protocol), and can be decoded either by a first decoder (which decodes the first encoded audio data and ignores the second encoded audio data) or by a second decoder (which decodes the second encoded audio data and ignores the first encoded audio data).

The FIG. 3 bitstream is indicative of a sequence of hyperframes of encoded audio data, each hyperframe (representing a time window of 128 msec) including seven frames of encoded audio data: a first frame of DD+ encoded data (e.g., DD+ frame 1 of FIG. 3), a first frame of HE AAC encoded data (e.g., HE AAC frame 1 of FIG. 3), a second frame of DD+ encoded data (e.g., DD+ frame 2 of FIG. 3), a second frame of HE AAC encoded data (e.g., HE AAC frame 2 of FIG. 3), a third frame of DD+ encoded data (e.g., DD+ frame 3 of FIG. 3), a third frame of HE AAC encoded data (e.g., HE AAC frame 3 of FIG. 3), and a fourth frame of DD+ encoded data (e.g., DD+ frame 4 of FIG. 3).

The encoder which generates the FIG. 3 bitstream inserts the indicated sequence of bits into each frame of HE AAC encoded data in the bitstream: sync bits ("ADTS") just before a burst of HE AAC encoded audio data, metadata following the HE AAC encoded audio data, and frame end bits (TERM) following the metadata. In operation to decode the FIG. 3 bitstream, the second decoder recognizes the sync bits as the start of a frame of data (encoded in accordance with the HE AAC protocol) to be decoded, recognizes the frame end bits as the end of the frame, and ignores each frame of DD+ encoded data (since each such frame occurs before the first HE AAC frame start, or after the end of an HE AAC frame but before the start of the next HE AAC frame).

The encoder which generates the FIG. 3 bitstream inserts the indicated sequence of bits into each frame of DD+ encoded data in the bitstream: sync bits ("SYNC") and then metadata before a burst of DD+ encoded audio data, control bits after the encoded audio data to indicate that a DD+ decoder (the first decoder) should treat the next bits as data (AUX_data or Skip data) to be skipped (each frame of HE AAC encoded data occurs in such a burst of bits to be skipped by a DD+ decoder), and sometimes then additional DD+ encoded data and/or control bits, and CRC bits at the end of the frame (just before the sync bits at the start of the next frame of DD+ encoded data). After each frame of HE AAC encoded data, the encoder inserts control bits ("DSE" in FIG. 3) indicating to the second decoder that it should ignore (as an HE AAC "data stream element") the following bits until it identifies the next sync bits ("ADTS") which identify a next frame of HE AAC encoded data. These latter control bits ("DSE" in FIG. 3) occur during in intervals of the DD+ frames which will be skipped by the first decoder.

Figure 4:
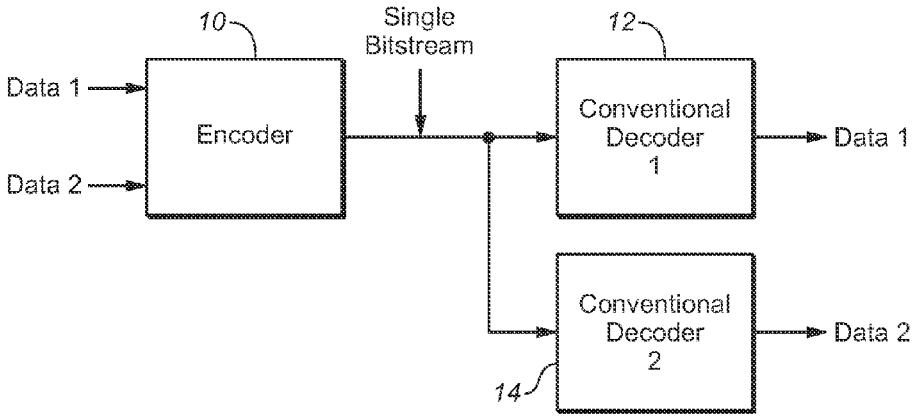
FIG. 4 is block diagram of a system including an embodiment of the inventive encoder (encoder 10), and two decoders (12 and 14) with which the encoder is compatible.

FIG. 4 is block diagram of a system including an embodiment of the inventive encoder (encoder 10), and two decoders (12 and 14) with which encoder 10 is compatible in the sense that each of decoders 12 and 14 can decode encoded audio data included in a bitstream generated by (and output from) encoder 10. Encoder 10 is preferably a perceptual encoding system, and is configured to generate a single ("unified") bitstream including one or both of audio data encoded in accordance with a first encoding protocol and audio data encoded in accordance with a second encoding protocol. The unified bitstream is decodable by decoder 12 (which in some embodiments is a conventional decoder, and is configured to decode audio data encoded in accordance with the first encoding protocol but not data encoded in accordance with the second encoding protocol) and by decoder 14 (which in some embodiments is a conventional decoder, and is configured to decode audio data encoded in accordance with the second encoding protocol but not data encoded in accordance with the first encoding protocol). In some embodiments, the first encoding protocol is a multichannel Dolby Digital Plus (DD+) protocol, and the second encoding protocol is a stereo AAC, HE AAC v1, or HE AAC v2 protocol.

The unified bitstream can include both encoded data (e.g., bursts of data) decodable by decoder 12 (and ignored by decoder 14) and encoded data (e.g., other bursts of data) decodable by decoder 14 (and ignored by decoder 12). In effect, the second encoding format is hidden within the unified bitstream when the bitstream is decoded by decoder 12, and the first encoding format is hidden within the unified bitstream when the bitstream is decoded by decoder 14.

Figure 5:
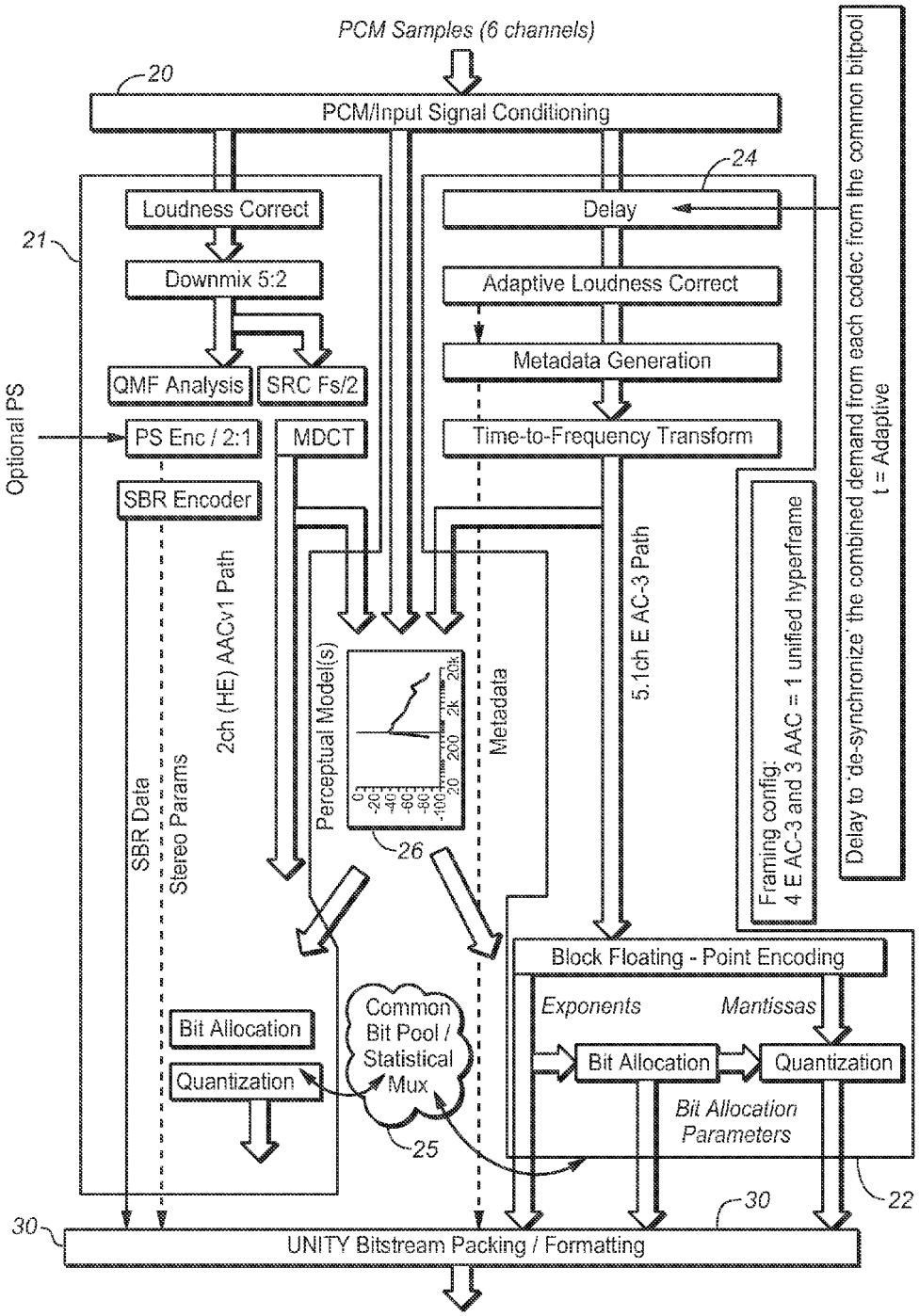
FIG. 5 is a diagram of an embodiment of the inventive encoder, showing modules of the encoder and operations performed by the encoder.

FIG. 5 is a diagram of an embodiment of the inventive encoder, showing modules of the encoder and operations performed by the encoder. Audio samples are asserted as input to the input signal conditioning block 20 of the FIG. 5 encoder. In a typical implementation, the samples are PCM audio samples indicative of six channels of input audio data. In response to the input audio data, the FIG. 5 encoder generates a single unified bitstream, and asserts the unified stream at the output of bitstream packing and formatting block 30.

The FIG. 5 encoder includes HE AAC encoding subsystem 21 (which is configured to encode some or all of the input data, after the input data undergo conditioning in block 20, in accordance with the HE AAC v1 encoding protocol) and DD+ encoding subsystem 22 (which is configured to encode some or all of the input data, after the input data undergo conditioning in block 20, in accordance with the E AC-3 encoding protocol). Block 30 is operable to time-division multiplex HE AAC v1 encoded audio data output from subsystem 21 with E AC-3 (DD+) encoded audio data output from subsystem 22 and with sync and control bits (e.g., of any of the types described herein with reference to FIGS. 1, 2, and 3) to generate the unified bitstream in accordance with an embodiment of the invention. The samples output from block 20 are processed in accordance with one or more perceptual models (in block 26) to determine parameters that are applied to implement processing in subsystems 21 and 22

The samples that are output from block 20 are also processed in block 25 (labeled "common bit pool/statistical mux"). These samples are a shared or common bitpool (input bits that are shared between encoding subsystems 21 and 22). Block 25 generates control values (for subsystems 21 and 22) which effectively distribute the available bits in the shared bitpool between encoding subsystems 21 and 22, preferably to optimize the overall audio quality of the unified bitstream (e.g., to encode more or less of the available bits using one of encoding subsystems 21 and 22, and the rest of the available bits using the other one of encoding subsystems 21 and 22, depending on results of statistical analysis of the shared bitpool performed in block 25). By use of block 25, the FIG. 5 encoder distributes bits from the shared bitpool between two encoding subsystems, preferably with knowledge of the input bit rate and the maximum hyperframe length of the unified output bitstream, by determining how many bits of input data (indicated by frequency-domain coefficients output from the Time-to-Frequency domain Transform stage of encoding subsystem 22) to assign to each quantized mantissa of the E AC-3 encoded frequency-domain coefficients, and how many bits of input data (indicated by frequency-domain coefficients output from the "MDCT" (modified discrete cosine transform) stage of encoding subsystem 21) to assign to the quantized HE AAC v1 code words output from subsystem 21. In contrast with the FIG. 5 system, a conventional E AC-3 encoder would include a bit allocation element configured to determine how many bits of input data to assign to each quantized mantissa of the E AC-3 encoded frequency-domain coefficients (generated by the E AC-3 encoder) in a manner independent of consideration of the need to multiplex the E AC-3 encoded data into a unified bitstream, and a conventional HE AAC v1 encoder would include a bit allocation element configured to determine how many bits of input data to assign to each quantized HE AAC v1 code word (generated by the HE AAC v1 encoder) in a manner independent of consideration of the need to multiplex the HE AAC v1 encoded data into a unified bitstream. Preferably, the bit rate of the input shared bitpool, and the maximum hyperframe length (of the output, combined bit stream) are known, and are used to optimize the bit allocation performed between encoding subsystems 21 and 22 to generate (in block 3) an optimized, combined output bit stream.

Delay block 24 of FIG. 5 is provided to adaptively delay the samples (output from block 20) to be encoded by the remaining portion of DD+ encoding subsystem 22. The samples (output from block 20) to be HE AAC v1 encoded by HE AAC encoding subsystem 21 are not delayed by block 24. To reduce the simultaneous demand (by encoding subsystems 21 and 22) for bits from the common pool, block 24 can de-synchronize the two encoding subsystems by N audio samples and/or blocks, e.g., when the input bits to be encoded (by subsystems 21 and 22) are indicative of a complex or difficult audio passage and/or scene. In some implementations of the FIG. 5 encoder (and in some other embodiments of the inventive encoder), the shared bitpool provides a mechanism for ensuring that groups of data frames (of the unified output bitstream) represent a fixed number of input audio samples or a specific number of input bits (to simplify downstream processes such as bitstream packetization and multiplexing with video).

In some embodiments of the inventive encoder (e.g., those to be described with reference to FIGS. 6, 7, and 8), a de-synchronizing adaptive delay (e.g., delay block 24 of FIGS. 6, 7, and 8) is implemented in one encoding path and a second adaptive delay (e.g., delay block 101 of FIGS. 6, 7, and 8) is also adaptively implemented within another (complementary) encoder path to correct the timing offset induced by the de-synchronizing delay (which is typically applied prior to bit allocation and quantizing). In typical embodiments, the encoder generates a control signal (carrying the current timing offset generated by the adaptive de-synchronizing delay) for use by a system packetizer and multiplexer (e.g., MPEG 2 or MPEG4 mux). This provides a mechanism for the system (which includes or is coupled to the inventive encoder) to properly schedule the delivery of data packets carrying the unified bitstream.

Figure 6:
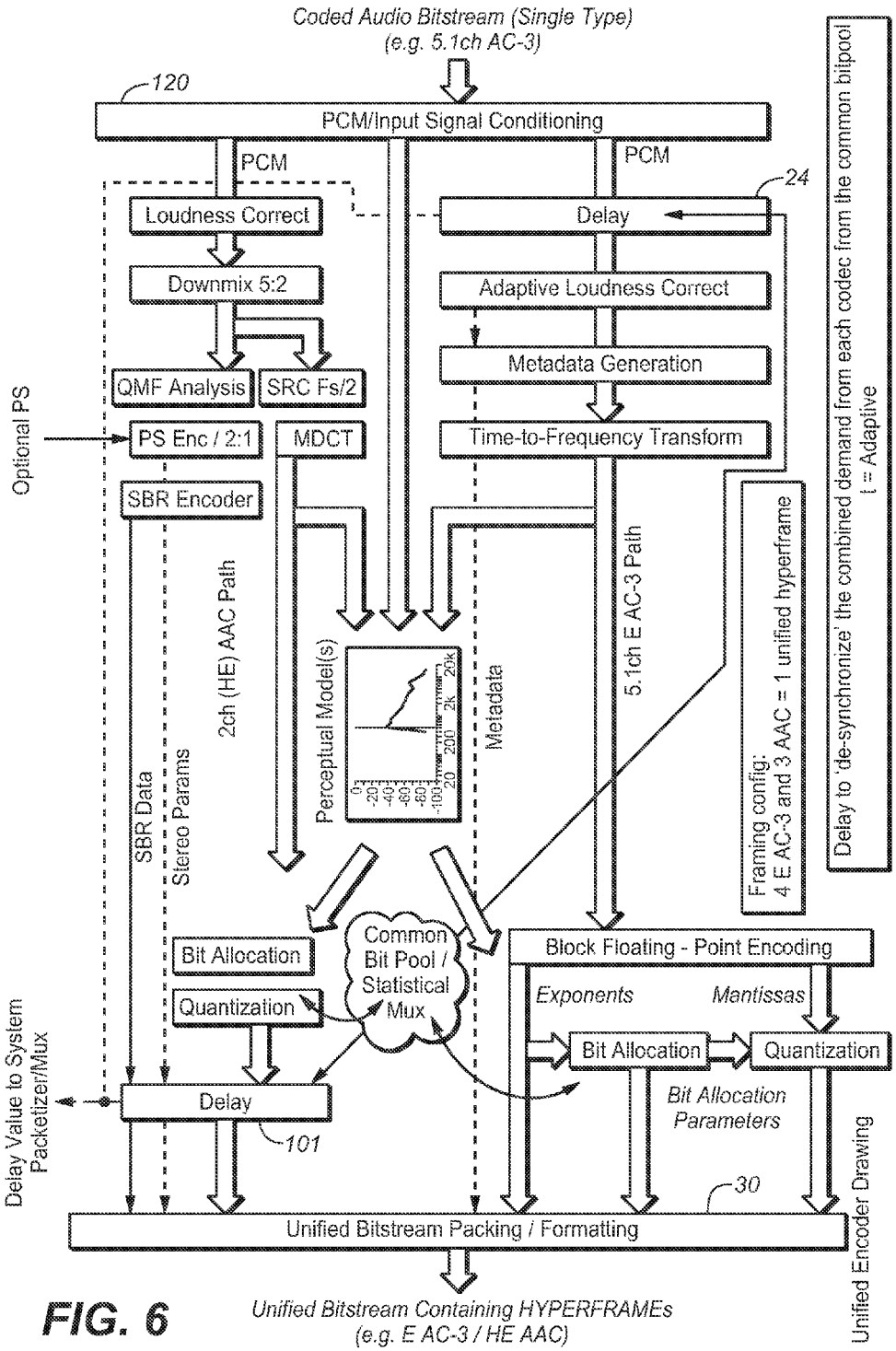
FIG. 6 is a diagram of another embodiment of the inventive encoder, showing modules of the encoder and operations performed by the encoder.

FIG. 6 is a diagram of an embodiment of the inventive encoder (which is a variation on the FIG. 5 embodiment) showing modules of the encoder and operations performed by the encoder. A coded audio bitstream (e.g., a 5.1 channel AC-3 encoded bitstream) is asserted as input to PCM/input signal conditioning block 120 of the FIG. 6 encoder. In response, block 120 outputs PCM audio samples indicative of six channels of input audio data. In response to the input audio data, the FIG. 6 encoder generates a single unified bitstream, and asserts the unified stream at the output of bitstream packing and formatting block 30.

The FIG. 6 encoder is identical to that of FIG. 5 except as described in the previous paragraph, and in that its HE AAC encoding subsystem (which is configured to encode some or all of the input data from block 120 in accordance with the HE AAC v1 encoding protocol or another HE AAC encoding protocol version) includes adaptive delay block 101 to correct the timing offset induced by the de-synchronizing delay block 24 (which is implemented in the DD+ encoding subsystem at a stage prior to the bit allocation and quantizing stage). The FIG. 6 encoder generates a control signal (carrying the current timing offset generated by the adaptive de-synchronizing delay block 24) for use by a system packetizer and multiplexer (e.g., MPEG 2 or MPEG4 mux). This provides a mechanism for the system (which includes or is coupled to the encoder) to properly schedule the delivery of data packets carrying the unified bitstream.

Figure 7:
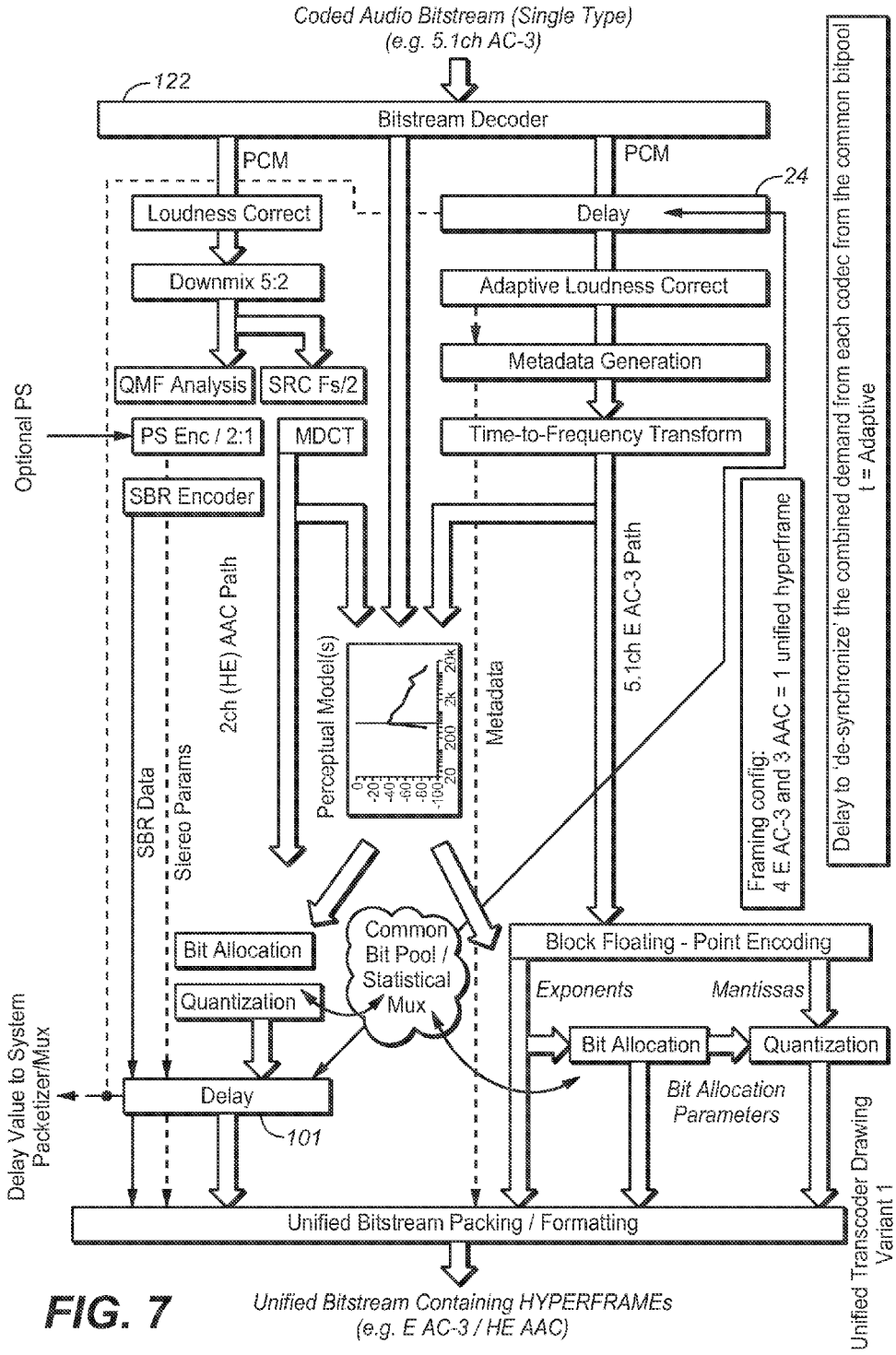
FIG. 7 is a diagram of another embodiment of the inventive encoder, showing modules of the encoder and operations performed by the encoder.

The FIG. 7 encoder is identical to that of FIG. 6 except in that PCM/input signal conditioning block 120 of FIG. 6 is replaced in the FIG. 7 encoder by input bitstream decoder 122. A coded audio bitstream (e.g., a 5.1 channel AC-3 encoded bitstream) is asserted as input to decoder 122 of the FIG. 7 encoder. In response, decoder 122 outputs PCM audio samples indicative of six channels of input audio data. In response to the input audio data, the FIG. 7 encoder generates a single unified bitstream, and asserts the unified stream at the output of bitstream packing and formatting block 30.

Figure 8:
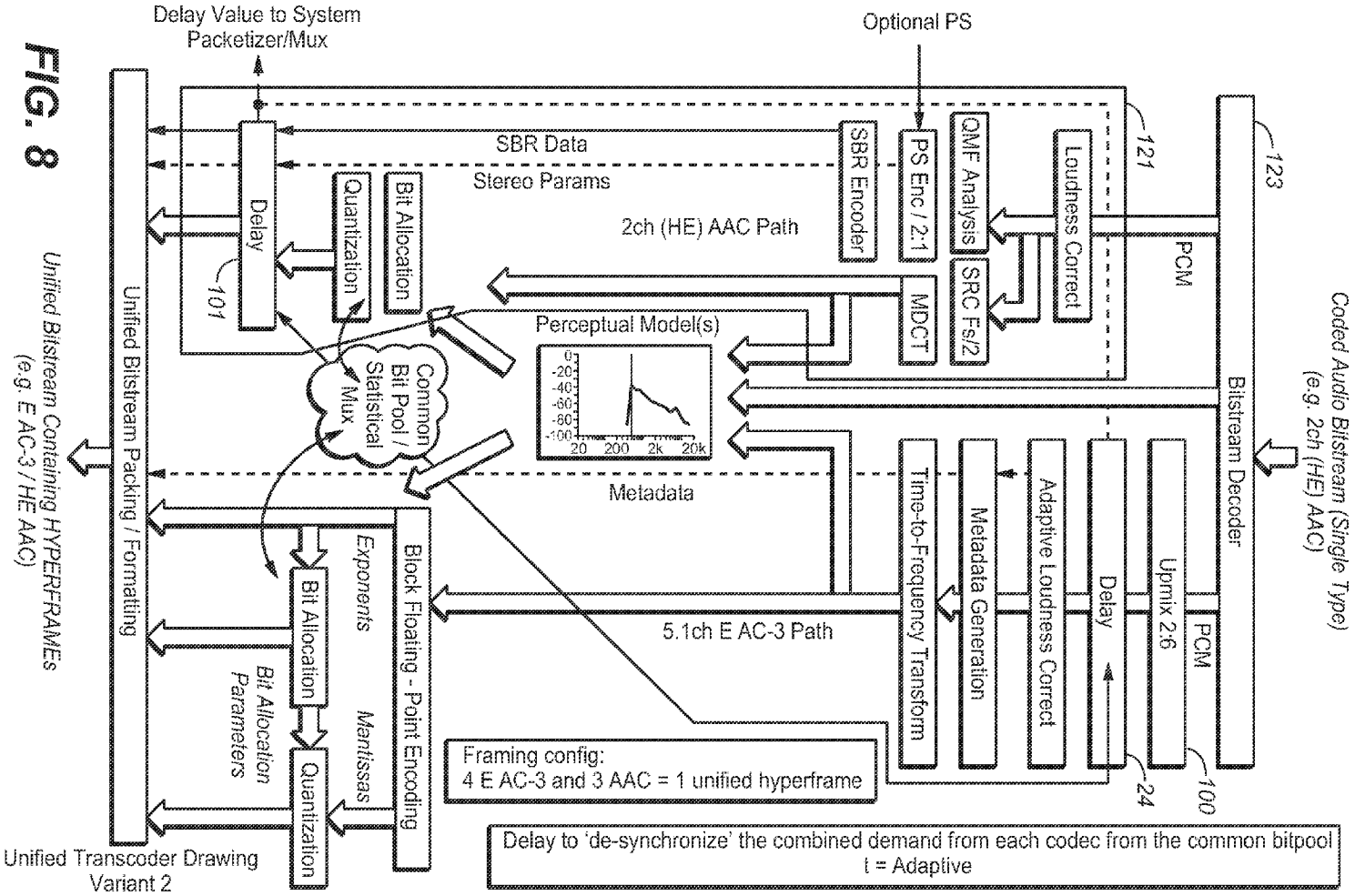
FIG. 8 is a diagram of another embodiment of the inventive encoder, showing modules of the encoder and operations performed by the encoder.

The FIG. 8 encoder is identical to that of FIG. 7 except in the following respects. A coded audio bitstream (e.g., a two channel HE AAC encoded bitstream) is asserted as input to input bitstream decoder 123 of the FIG. 7 encoder. In response, decoder 123 outputs PCM audio samples indicative of two channels of input audio data. In response to the input audio data, the FIG. 8 encoder generates a single unified bitstream, and asserts the unified stream at the output of bitstream packing and formatting block 30. The DD+ encoding subsystem of FIG. 8 (which is configured to encode some or all of the input data in accordance with the E AC-3 encoding protocol) includes an initial upmixing module 100 which is operable to upmix the two-channel (stereo) input data from block 123 to 5.1 channel multichannel audio data for subsequent processing (i.e., delay in adaptive delay block 24 followed by encoding as E AC-3 encoded data). Since the HE AAC encoding subsystem of FIG. 8 (identified by reference numeral 121) receives two-channel input audio, it does not include a 5:2 downmixing module (as does the HE AAC encoding subsystem of each of FIGS. 5, 6, and 7. In another class of embodiments, the inventive encoder generates a unified bitstream including DD+ data (data encoded in accordance with the DD+ protocol) sent as an independent substream of a DD+ encoded data stream (which a DD+ decoder will decode), and HE-AAC data (data encoded in accordance with an HE-AAC protocol) sent as a second (independent or dependent) DD+ substream of a DD+ encoded data stream (one which a DD+ decoder will ignore). More generally, in a class of embodiments the inventive encoder generates a unified bitstream including two or more independent substreams (each substream including data encoded in accordance with a different encoding protocol). For example, the substreams can be as defined within the well known standard known as ATSC A/52B Annex E. For example, the unified bitstream may include one substream ("substream 1") that is compliant with the syntax and decoder buffer constraints defined in ATSC A/52B Annex E, ATSC A/53, and ETSI/DVB XXXX respectively, and the unified bitstream may also include another substream ("substream 2") that is compliant with the syntax defined in MPEG 14496-3 but (after the interleaving/mux processing step performed to multiplex it with substream 1 in the unified bitstream) does not directly support the decoder buffer constraints defined in MPEG 14493-3 and ETSI XXXX. This approach retains direct compatibility for substream 1 with existing ATSC A/52B Annex E compliant decoders (without additional processing steps) yet requires an intermediate processing step prior to decoding for substream 2 (e.g. the MPEG 14496-3 part). The ATSC A/52B Annex E substream approach provides greater extensibility for the unified bitstream for future enhancements (e.g., channel counts >6, higher maximum bitrate, and associated bitstreams for the hearing or visually impaired, etc.) but with the penalty of not being compatible with both conventional decoders that support only the first encoding protocol (but not the second encoding protocol) and conventional decoders that support only the second encoding protocol (but not the first encoding protocol). Moreover, the embodiments described with reference to FIGS. 1, 2, and 3 above have a maximum combined bitrate (bitstream 1+bitstream 2) limitation, which is determined by the maximum frame size defined in MPEG 14496-

3. In contrast, the embodiments that generate a unified bitstream including substreams (as described in the present paragraph) are not subject to this maximum combined bitrate limitation.

Consider an embodiment of the inventive encoder that generates a unified bitstream including multiple substreams (as described in the previous paragraph), including a substream comprising MPEG 14496-3 audio data. In order to decode the MPEG 14496-3 data (substream 2 of the unified bitstream), intermediate processing steps must be taken prior to decoding (by a conventional MPEG 14496-3 decoder) including: parsing and de-multiplexing the applicable substream (substream 2 in the example) from the unified (combined) bitstream; and reassembling the de-multiplexed (and parsed) data bytes into a contiguous MPEG 14496-3 compliant bitstream.

Figure 4A:
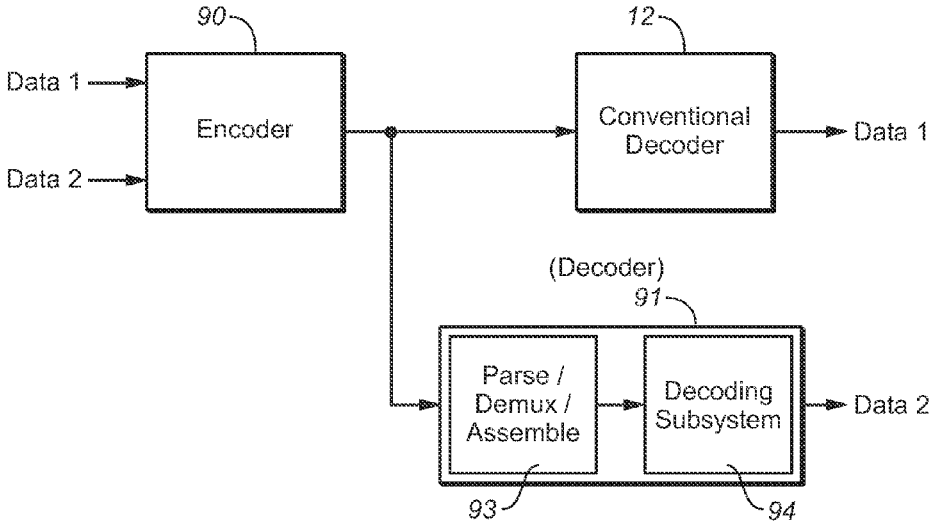
FIG. 4A is block diagram of a system including another embodiment of the inventive encoder (encoder 90), and two decoders (12 and 91) with which the encoder is compatible.

FIG. 4A is block diagram of a system including an embodiment of the inventive encoder (encoder 90), and two decoders (12 and 91) with which encoder 90 is compatible in the sense that each of decoders 12 and 91 can decode encoded audio data included in a bitstream generated by (and output from) encoder 90. Encoder 90 is preferably a perceptual encoding system, and is configured to generate a unified bitstream including one or both of audio data encoded in accordance with a first encoding protocol and audio data encoded in accordance with a second encoding protocol. The unified bitstream includes two or more substreams, each substream including data encoded in accordance with a different one of the encoding protocols (e.g., the bitstream includes DD+ data encoded in accordance with the DD+ protocol and sent as an independent substream of a DD+ encoded data stream, and HE-AAC data encoded in accordance with an HE-AAC protocol and sent as a second (independent or dependent) substream of a DD+ encoded data stream). The unified bitstream is decodable by decoder 12 (which in some embodiments is a conventional decoder) in the sense that decoder 12 is configured to recognize and decode audio data (in the unified bitstream) that is encoded in accordance with the first encoding protocol. In operation, the unified bitstream is received at least one input of decoder 12, and a decoding subsystem of decoder 12 operates by recognizing and decoding audio data (indicated by the unified bitstream) that has been encoded in accordance with the first encoding protocol and ignoring additional audio data in the unified bitstream that has been encoded in accordance with the second encoding protocol. For example, when the unified bitstream includes an independent substream of DD+ data, decoder 12 can be a conventional DD+ decoder configured to decode audio that has been encoded in accordance with the DD+ protocol. The unified bitstream is also decodable by decoder 91 (which is not a conventional decoder) in the sense that decoder 91 is configured in accordance with an embodiment of the present invention to parse and demultiplex one of the substreams of the unified bitstream (the substream encoded in accordance with the second encoding protocol) and to assemble the demultiplexed data into a contiguous stream of data (encoded in accordance with the second encoding protocol). These operations are performed by subsystem 93 of decoder 91. Decoding subsystem 94 of decoder 91 is coupled to the output of subsystem 93 and is configured to decode the contiguous stream of encoded data output from subsystem 93. For example, when the second encoding protocol is an HE-AAC protocol (e.g., stereo HE AAC v1 or HE AAC v2), and the unified bitstream includes a second (independent or dependent) substream of HE-AAC data encoded in accordance with the HE-AAC protocol and sent as a (dependent or independent) substream of a DD+ encoded data stream, subsystem 93 parses and demultiplexes the second substream from the unified bitstream assembles the demultiplexed data into a contiguous stream of HE-AAC data, and subsystem 94 decodes (in accordance with the HE-AAC decoding protocol) the contiguous stream of HE-AAC data that is output from subsystem 93.

The methods and systems for creating a unified bitstream described herein preferably provide the ability to unambiguously signal (to a decoder) which interleaving approach is utilized within a unified bitstream (e.g. to signal whether the AUX, SKIP/DSE approach of FIGS. 1, 2, and 3, or the EAC-3 substream approach described in the two preceding paragraphs, is utilized) One method for doing so is to include in the unified bitstream a new BSID (bit stream identification) value (of the type carried with the BSI (bitstream information) fields of AC-3 or E AC-3 frames) that identifies the interleaving approach used to generate the unified bitstream.

Perceptual audio encoders generate "frames" of compressed (rate reduced) information that are independently decodable and represent a specific interval of time (representing a fixed number of audio samples). Thus, different audio coding systems typically generate "frames" representing a unique time interval that is directly related to the number of audio blocks (containing a specific number of audio samples) supported within the time-to-frequency transform sub-function of the coding system itself (e.g., MDCT, etc). By combining two or more bitstreams from several different coding systems, a complication arises with any type of bitstream processing that may be encountered in a media distribution system. This includes bitstream splicing operations, where a 'splice' must occur at a "frame" boundary. Otherwise, partial/fragmented compressed data frames will be created and downstream decoders could be prone to produce adverse "audible" effects at their output and/or sync slips/timing drift could occur (impacting lip sync). The unified coding system and unified output bitstream implemented by typical embodiments of the present invention interleaves (multiplexes) bitstreams from two different audio coding systems (bitstreams 1 and 2) having different "framing" into a single "hyperframe" that comprises an integer number of frames from bitstream 1 and bitstream 2 thereby representing the same time interval. Splicing and/or switching at the hyperframe boundary will not generate partial and/or fragmented frames from the underlying bitstreams (i.e., bitstream 1 or bitstream 2)

In another class of embodiments, the present invention is implemented as (or within) a transcoder. For example, an embodiment of the invention is a transcoder configured to generate a unified output bitstream containing two streams of data encoded in accordance with different protocols (e.g., bitstream 1 and bitstream 2 as defined above) but sourced from data encoded in accordance with only one of the protocols (e.g., bitstream 1 only, so that bitstream 1 is the only stream available at the transcoder's input). The transcoder is configured and operable to decode (and to downmix, if applicable) the input bitstream 1 to generate decoded data that are re-encoded as bitstream 2. The original bitstream 1 is then interleaved with the newly created bitstream "2" to complete the generation of the unified bitstream, which is asserted at the transcoder output. For another example, an embodiment of the invention is a transcoder as defined in the previous example but wherein the single input bitstream is bitstream 2 (bitstream 2 is the source) and wherein the transcoder is configured to generate bitstream 1 from bitstream 2 via a decode operation (including an upmix operation if applicable), and then to combine bitstreams 1 and 2 into the unified bitstream. For another example, an embodiment of the invention is a transcoder operable to decode (including by upmixing or downmixing if applicable) an input bitstream 3 (encoded in accordance with a third encoding format) to generate decoded data that are re-encoded as both a bitstream 1 (in a first encoding format) and a bitstream 2 (in a second encoding format). The re-encoded bitstreams 1 and 2 are then interleaved to complete the generation of the unified bitstream, which is asserted at the transcoder output.

In another class of embodiments the invention is a method for decoding a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, said method including the steps of:

(a) providing the unified bitstream to a decoder configured to decode audio data that have been encoded in accordance with the first encoding protocol; and (b) decoding the unified bitstream using the decoder, including by decoding the first encoded audio data and ignoring the additional encoded audio data.

In some such embodiments, the first encoding protocol is a multichannel Dolby Digital Plus protocol, the second encoding protocol is one of a stereo AAC protocol, a stereo HE AAC v1 protocol, and a stereo HE AAC v2 protocol. In other embodiments in the class, the second encoding protocol is a multichannel Dolby Digital Plus protocol, the first encoding protocol is one of a stereo AAC protocol, a stereo HE AAC v1 protocol, and a stereo HE AAC v2 protocol. Step (b) can include a step of recognizing bits in the unified bitstream that indicate that a set of subsequent bits should be ignored rather than decoded.

In another class of embodiments the invention is a decoder configured to decode a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol. The decoder includes at least one input configured to receive the unified bitstream; and a decoding subsystem coupled to the at least one input and configured to decode audio data that have been encoded in accordance with the first encoding protocol, wherein the decoding subsystem is configured to decode the first encoded audio data in the unified bitstream and to ignore the additional encoded audio data in the unified bitstream. In some such embodiments, the first encoding protocol is a multichannel Dolby Digital Plus protocol. In other embodiments in the class, the first encoding protocol is one of a stereo AAC protocol, a stereo HE AAC v1 protocol, and a stereo HE AAC v2 protocol. The decoding subsystem can be configured to recognize bits in the unified bitstream that indicate that a set of subsequent bits should be ignored rather than decoded.

Figure 9:
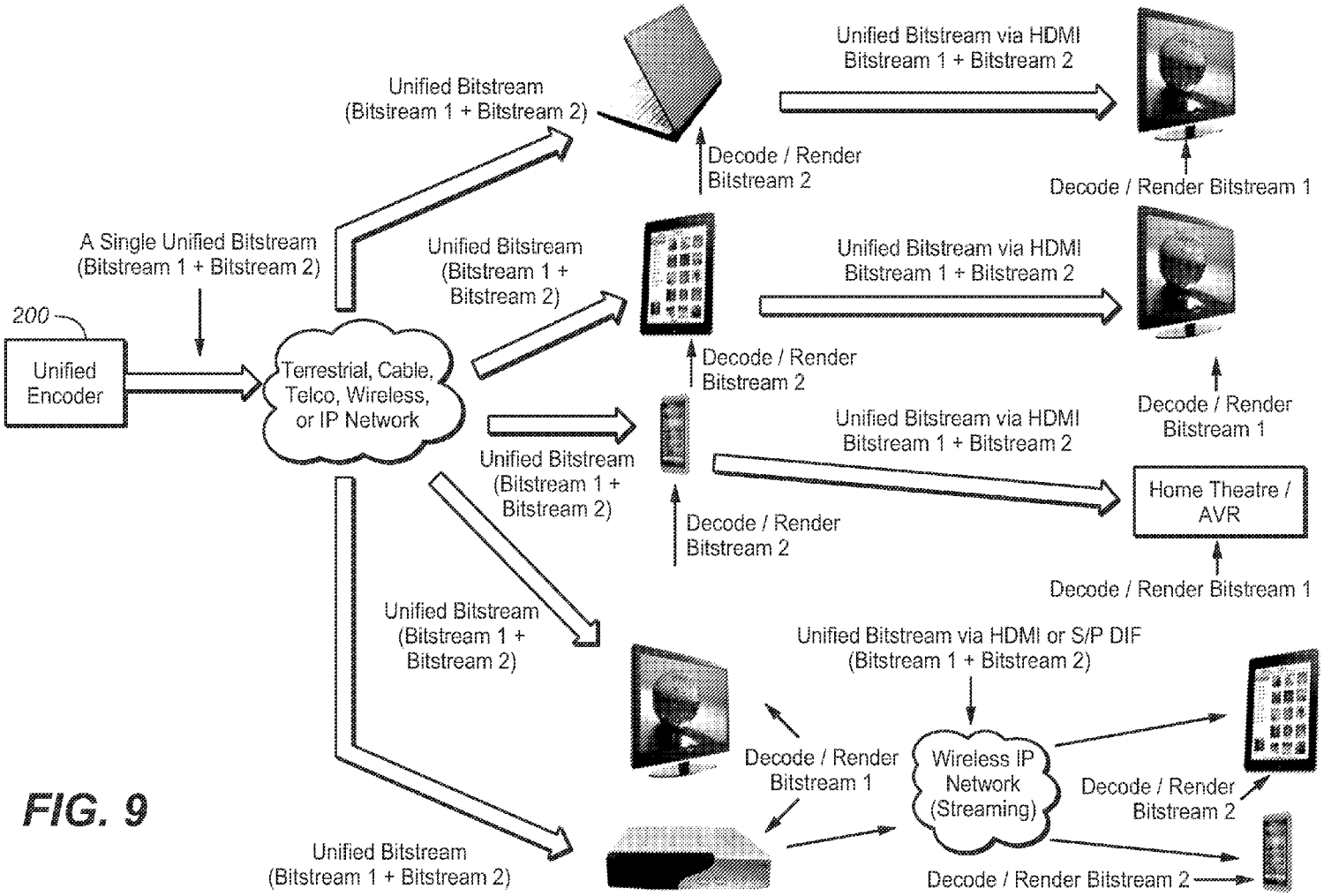
FIG. 9 is a diagram of an embodiment of the inventive encoder which outputs a unified bitstream, and examples of systems and devices to which the unified bitstream may be provided.

FIG. 9 is a diagram of an embodiment of the inventive encoder (encoder 200) which outputs a unified bitstream. FIG. 9 shows examples of systems and devices to which the unified bitstream may be provided, including a terrestrial, cable, telco, wireless, or IP network which transmits the unified bitstream to any of a variety of processing devices configured to decode and render data of the bitstream that has been encoded in accordance with a second encoding protocol, and to assert the bitstream (e.g., over an HDMI link) to other processing devices configured to decode and render data of the unified bitstream that has been encoded in accordance with a first encoding protocol. The network (terrestrial, cable, telco, wireless, or IP network) also transmits the unified bitstream to a processing system (e.g., including devices configured to decode and render data of the bitstream that has been encoded in accordance with a first encoding protocol), which then reasserts the bitstream (e.g., by streaming it over a wired or wireless IP network) to processing devices configured to decode and render data of the unified bitstream that has been encoded in accordance with a second encoding protocol.

Thus, some embodiments of the inventive audio encoding method include a step of generating a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with the first encoding protocol and the second encoding protocol, allowing a multimedia or data streaming server (e.g., a server of the network of FIG. 9 labeled "Wireless IP Network (streaming)") to support streaming and/or transport of the unified bitstream, wherein said multimedia or data streaming server supports only one of the first encoding protocol and the second encoding protocol.

Thus, an embodiment of the invention is a system including:

an audio encoder (e.g., encoder 200 of FIG. 9) configured to generate a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with the first encoding protocol and the second encoding protocol; and a server (e.g., a server of the network shown in FIG. 9 having the label "Wireless IP Network (streaming)") coupled to receive the unified bitstream and configured to stream the unified bitstream to at least one processing device configured to decode and render data of the unified bitstream, wherein said server supports only one of the first encoding protocol and the second encoding protocol.

In some embodiments, the inventive system is or includes a general purpose processor coupled to receive or to generate input data indicative of an X-channel audio input signal (or input data indicative of a first X-channel audio input signal to be encoded in accordance with a first encoding protocol and a second Y-channel audio input signal to be encoded in accordance with a second encoding protocol) and programmed with software (or firmware) and/or otherwise configured (e.g., in response to control data) to perform any of a variety of operations on the input data, including an embodiment of the inventive method, to generate data indicative of a single, unified encoded bitstream. Such a general purpose processor would typically be coupled to an input device (e.g., a mouse and/or a keyboard), a memory, and a display device. For example, encoder 10 of FIG. 4 could be implemented in a general purpose processor, with DATA 1 being input data indicative of X channels of audio data to be encoded in accordance with a first encoding protocol and DATA 2 being input data indicative of Y channels of audio data to be encoded in accordance with a second encoding protocol, and the single unified bitstream asserted by encoder 10 (to decoder 12 or 14) being determined by output data generated (in accordance with an embodiment of the invention) in response to the input data. For another example, the encoder described with reference to FIG. 5 could be implemented in a general purpose processor, with the PCM samples (asserted to the input of block 20) being input data indicative of six channels of audio data, and the unified bitstream asserted at the output of packing and formatting block 30 being determined by output data generated (in accordance with an embodiment of the invention) in response to the input data.

In some embodiments, the invention is a decoder (e.g., any of those shown in FIG. 9 as receiving the unified bitstream generated by encoder 200, or decoder 91 of FIG. 4A) configured to decode a unified bitstream generated by an encoder, wherein the unified bitstream includes at least two substreams, the substreams including a first independent substream of data encoded in accordance with a first encoding protocol and a second substream of data encoded in accordance with a second encoding protocol, wherein said decoder includes:

a first subsystem configured to parse and demultiplex the second substream from the unified bitstream, thereby determining demultiplexed data, and to assemble the demultiplexed data into a contiguous stream of data encoded in accordance with the second encoding protocol; and a decoding subsystem coupled to the first subsystem and configured to decode the contiguous stream of data.

In some cases, the first encoding protocol is the DD+ protocol, and the first independent stream and the second substreams are substreams of a DD+ encoded data stream.

In some case, the second encoding protocol is one of a stereo AAC protocol, a stereo HE AAC v1 protocol, and a stereo HE AAC v2 protocol.

In some embodiments, the invention is a method for decoding a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, said method including the steps of:

(a) providing the unified bitstream to a decoder configured to decode audio data that have been encoded in accordance with the first encoding protocol; and (b) decoding the unified bitstream using the decoder, including by decoding the first encoded audio data and ignoring the additional encoded audio data. In some cases, the first encoding protocol is a multichannel Dolby Digital Plus protocol, the second encoding protocol is one of a stereo AAC protocol, a stereo HE AAC v1 protocol, and a stereo HE AAC v2 protocol. In some cases, the second encoding protocol is a multichannel Dolby Digital Plus protocol, the first encoding protocol is one of a stereo AAC protocol, a stereo HE AAC v1 protocol, and a stereo HE AAC v2 protocol. Optionally, step (b) includes a step of recognizing bits in the unified bitstream that indicate that a set of subsequent bits should be ignored rather than decoded.

In some embodiments, the invention is a decoder (e.g., any of those shown in FIG. 9 as receiving the unified bitstream generated by encoder 200) configured to decode a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, said decoder including:

at least one input configured to receive the unified bitstream; and a decoding subsystem coupled to the at least one input and configured to decode audio data that have been encoded in accordance with the first encoding protocol, wherein the decoding subsystem is configured to decode the first encoded audio data in the unified bitstream and to ignore the additional encoded audio data in the unified bitstream.

In some cases, the first encoding protocol is a multichannel Dolby Digital Plus protocol. In other cases, the first encoding protocol is one of a stereo AAC protocol, a stereo HE AAC v1 protocol, and a stereo HE AAC v2 protocol. Optionally, the decoding subsystem is configured to recognize bits in the unified bitstream that indicate that a set of subsequent bits should be ignored rather than decoded.

In some embodiments, the invention is an audio encoding system configured to generate a single, unified bitstream that is decodable by a first decoder configured to decode audio data encoded in accordance with a first encoding protocol, and by a second decoder configured to decode audio data encoded in accordance with a second encoding protocol. In some such embodiments, the first encoding protocol is a multichannel Dolby Digital Plus protocol, and the second encoding protocol is one of a stereo AAC protocol, a stereo HE AAC v1 protocol, and a stereo HE AAC v2 protocol. In some such embodiments, the first encoding protocol is a multichannel Dolby Digital protocol, and the second encoding protocol is one of a stereo AAC protocol, a stereo HE AAC v1 protocol, and a stereo HE AAC v2 protocol. In some such embodiments, the first encoding protocol is a multichannel Dolby Digital protocol, and the second encoding protocol is one of a multichannel Dolby Digital Plus protocol, stereo AAC protocol, a stereo HE AAC v1 protocol, and a stereo HE AAC v2 protocol. In some such embodiments, the first encoding protocol is one of a Mono Dolby Digital protocol and a Stereo Dolby Digital protocol, and the second encoding protocol is a multichannel Dolby Digital Plus protocol. In some such embodiments, the first encoding protocol is one of a Mono Dolby Digital protocol and a Stereo Dolby Digital protocol, and the second encoding protocol is one of a multichannel AAC protocol, and a multichannel HE AAC v1 protocol.

In some embodiments, the invention is an audio encoding method including a step of generating a single, unified bitstream that is decodable by a first decoder configured to decode audio data encoded in accordance with a first encoding protocol, and by a second decoder configured to decode audio data encoded in accordance with a second encoding protocol. In some such embodiments, the first encoding protocol is a multichannel Dolby Digital Plus protocol, and the second encoding protocol is one of a stereo AAC protocol, a stereo HE AAC v1 protocol, and a stereo HE AAC v2 protocol. In some such embodiments, the first encoding protocol is a multichannel Dolby Digital protocol, and the second encoding protocol is one of a stereo AAC protocol, a stereo HE AAC v1 protocol, and a stereo HE AAC v2 protocol. In some such embodiments, the first encoding protocol is a multichannel Dolby Digital protocol, and the second encoding protocol is one of a multichannel Dolby Digital Plus protocol, stereo AAC protocol, a stereo HE AAC v1 protocol, and a stereo HE AAC v2 protocol. In some such embodiments, the first encoding protocol is one of a Mono Dolby Digital protocol and a Stereo Dolby Digital protocol, and the second encoding protocol is a multichannel Dolby Digital Plus protocol. In some such embodiments, the first encoding protocol is one of a Mono Dolby Digital protocol and a Stereo Dolby Digital protocol, and the second encoding protocol is one of a multichannel AAC protocol, and a multichannel HE AAC v1 protocol.

In some embodiments, the invention is a decoder configured to decode a unified bitstream generated by an encoder, wherein the unified bitstream includes at least two substreams, said substreams including a first independent substream of data encoded in accordance with a first encoding protocol and a second substream of data encoded in accordance with a second encoding protocol, wherein said decoder includes:

a first subsystem configured to parse and demultiplex the second substream from the unified bitstream, thereby determining demultiplexed data, and to assemble the demultiplexed data into a contiguous stream of data encoded in accordance with the second encoding protocol; and a decoding subsystem coupled to the first subsystem and configured to decode the contiguous stream of data.

In some such embodiments: the first subsystem is configured to assemble the demultiplexed data into said contiguous stream of data encoded in accordance with the second encoding protocol and a second stream of data encoded in accordance with the first encoding protocol, and the decoder (e.g., the first subsystem of the decoder) is configured to forward the second stream of data to a secondary device, via at least one of a wired and a wireless network connection, wherein the secondary device supports decoding of data encoded in accordance with the first encoding protocol but not decoding of data encoded in accordance with the second encoding protocol; or the first encoding protocol is the Dolby Digital Plus protocol, and the first independent stream and the second substreams are substreams of a Dolby Digital Plus encoded data stream; or the second encoding protocol is one of a stereo AAC protocol, a stereo HE AAC v1 protocol, and a stereo HE AAC v2 protocol; or the first encoding protocol is the Dolby Digital protocol, and the first independent substream and the second substream are substreams of a Dolby Digital Plus encoded data stream; or the first encoding protocol is one of an AAC protocol, a HE AAC v1 protocol, and a HE AAC v2 protocol; or the second encoding protocol is one of a Dolby Digital protocol and a Dolby Digital Plus protocol; or the first encoding protocol is one of a Dolby Digital protocol and a Dolby Digital Plus protocol; or the second encoding protocol is an MPEG Spatial Audio Object Coding (SAOC) protocol (or another object-oriented protocol); or the first encoding protocol is an MPEG SAOC protocol (or another object-oriented protocol).

In some embodiments, the invention is a method for decoding a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, said method including the steps of:

(a) providing the unified bitstream to a decoder configured to decode audio data that have been encoded in accordance with the first encoding protocol; and (b) decoding the unified bitstream using the decoder, including by decoding the first encoded audio data and ignoring the additional encoded audio data.

In some such embodiments:

the first encoding protocol is a multichannel Dolby Digital Plus protocol, and the second encoding protocol is one of a stereo AAC protocol, a stereo HE AAC v1 protocol, and a stereo HE AAC v2 protocol; or the second encoding protocol is a multichannel Dolby Digital Plus protocol, and the first encoding protocol is one of a stereo AAC protocol, a stereo HE AAC v1 protocol, and a stereo HE AAC v2 protocol; or the first encoding protocol is one of a Dolby Digital protocol and a Dolby Digital Plus protocol; or the second encoding protocol is one of a stereo AAC protocol, a stereo HE AAC v1 protocol, and a stereo HE AAC v2 protocol; or the first encoding protocol is one of a AAC protocol, a HE AAC v1 protocol, and a HE AAC v2 protocol; or the second encoding protocol is one of a Dolby Digital and a Dolby Digital Plus protocol; or the second encoding protocol is an MPEG SAOC protocol (or another object-oriented protocol); or the first encoding protocol is an MPEG SAOC protocol (or another object-oriented protocol).

In some embodiments, the invention is a decoder configured to decode a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, said decoder including:

at least one input configured to receive the unified bitstream; and a decoding subsystem coupled to the at least one input and configured to decode audio data that have been encoded in accordance with the first encoding protocol, wherein the decoding subsystem is configured to decode the first encoded audio data in the unified bitstream and to ignore the additional encoded audio data in the unified bitstream.

In some such embodiments:

the first encoding protocol is a multichannel Dolby Digital Plus protocol; or the first encoding protocol is one of a stereo AAC protocol, a stereo HE AAC v1 protocol, and a stereo HE AAC v2 protocol; or the second encoding protocol is one of a stereo AAC protocol, a stereo HE AAC v1 protocol, and a stereo HE AAC v2 protocol; or the first encoding protocol is one of a protocol of an AAC protocol, a HE AAC v1 protocol, and a HE AAC v2 protocol; or the second encoding protocol is one of a Dolby Digital protocol and a Dolby Digital Plus protocol; or the first encoding protocol is one of a Dolby Digital protocol and a Dolby Digital Plus protocol; or the second encoding protocol is an MPEG SAOC protocol (or another object-oriented protocol); or the first encoding protocol is an MPEG SAOC protocol (or another object-oriented protocol).

In some embodiments, the invention is an audio encoding method including a step of generating a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with two or more encoding protocols.

In some embodiments, the invention is an audio encoding method including a step of generating a single, unified bitstream that is decodable by a first decoder configured to decode audio data encoded in accordance with a first encoding protocol, and by a second decoder configured to decode audio data encoded in accordance with a second encoding protocol, and wherein the step of generating the unified bitstream supports de-interleaving to generate a first bitstream including audio data encoded in accordance with the first encoding protocol and a second bitstream including audio data encoded in accordance with the second encoding protocol.

In some embodiments, the invention is an audio encoding method including a step of generating a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with the first encoding protocol and the second encoding protocol, allowing a multimedia or data streaming server to support at least one of streaming and transport of the unified bitstream, wherein said multimedia or data streaming server supports only one of the first encoding protocol and the second encoding protocol.

In some embodiments, the invention is a system including:

an audio encoder configured to generate a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with the first encoding protocol and the second encoding protocol; and a server coupled to receive the unified bitstream and configured to stream the unified bitstream to at least one processing device configured to decode and render data of the unified bitstream, wherein said server supports only one of the first encoding protocol and the second encoding protocol.

In some embodiments, the invention is a system including:

an audio encoder configured to generate a single, unified bitstream that is decodable by a first decoder configured to decode audio data encoded in accordance with a first encoding protocol, and by a second decoder configured to decode audio data encoded in accordance with a second encoding protocol, wherein the unified bitstream comprises hyperframes of encoded data encoded in accordance with the first encoding protocol and the second encoding protocol; and a server coupled to receive the unified bitstream and configured to stream to at least one processing device one of: frames of the bitstream encoded in accordance with the first protocol and frames of the bitstream encoded in accordance with the second protocol, wherein the server supports only one of the first encoding protocol and the second encoding protocol.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for decoding a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, wherein the first encoded data is interleaved with the additional encoded data with a start of a first frame of the first encoded data being provided before a start of a first frame of the additional encoded data, with an end of the first frame of the first encoded data being provided after the start of the first frame of the additional encoded data, with the start of the first frame of the additional encoded data being provided before a start of a second frame of the first encoded data, and with an end of the first frame of the additional encoded data being provided after the start of the second frame of the first encoded data, said method including the steps of:

(a) providing the unified bitstream to a decoder configured to decode audio data that have been encoded in accordance with the first encoding protocol; and (b) decoding the unified bitstream using the decoder configured to decode audio data that have been encoded in accordance with the first encoding protocol, including by decoding the first encoded audio data and ignoring the additional encoded audio data.

2. The method of claim 1, wherein the first encoding protocol is one of an AAC protocol, a HE AAC v1 protocol, a HE AAC v2 protocol, a Dolby Digital protocol, a Dolby Digital Plus protocol, and an object-oriented protocol.

3. The method of claim 1, wherein the first encoding protocol is one of an AAC protocol, a HE AAC v1 protocol, a HE AAC v2 protocol, a Dolby Digital protocol, a Dolby Digital Plus protocol, and an object-oriented protocol.

4. The method of claim 1, wherein step (b) includes recognizing bits in the unified bitstream that indicate that a set of subsequent bits should be ignored rather than decoded.

5. A decoder configured to decode a unified bitstream generated by an encoder, wherein the unified bitstream is indicative of first encoded audio data that have been encoded in accordance with a first encoding protocol and additional encoded audio data that have been encoded in accordance with a second encoding protocol, and the unified bitstream is decodable by a first decoder configured to decode audio data that have been encoded in accordance with the first encoding protocol, and by a second decoder configured to decode audio data that have been encoded in accordance with the second encoding protocol, wherein the first encoded data is interleaved with the additional encoded data with a start of a first frame of the first encoded data being provided before a start of a first frame of the additional encoded data, with an end of the first frame of the first encoded data being provided after the start of the first frame of the additional encoded data, with the start of the first frame of the additional encoded data being provided before a start of a second frame of the first encoded data, and with an end of the first frame of the additional encoded data being provided after the start of the second frame of the first encoded data, said decoder including:

at least one input configured to receive the unified bitstream; and a decoding subsystem coupled to the at least one input and configured to decode audio data that have been encoded in accordance with the first encoding protocol, wherein the decoding subsystem is configured to decode the first encoded audio data in the unified bitstream and to ignore the additional encoded audio data in the unified bitstream.

6. The decoder of claim 5, wherein the first encoding protocol is one of a protocol of an AAC protocol, a HE AAC v1 protocol, a HE AAC v2 protocol, a Dolby Digital protocol, a Dolby Digital Plus protocol, and an object-oriented protocol.

7. The decoder of claim 5, wherein the second encoding protocol is one of an AAC protocol, a HE AAC v1 protocol, a HE AAC v2 protocol, a Dolby Digital protocol, a Dolby Digital Plus protocol, and an object-oriented protocol.

8. The decoder of claim 5, wherein the decoding subsystem is configured to recognize bits in the unified bitstream that indicate that a set of subsequent bits should be ignored rather than decoded.

9. An audio encoding system configured to generate a single, unified bitstream that is decodable by a first decoder configured to decode audio data encoded in accordance with a first encoding protocol, and by a second decoder configured to decode audio data encoded in accordance with a second encoding protocol, wherein the unified bitstream includes first encoded data decodable by the first decoder, and second encoded data decodable by the second decoder, and wherein the first encoded data is multiplexed with the second encoded data, and the unified bitstream includes bits indicative to the second decoder that said second decoder should ignore the first encoded data and bits indicative to the first decoder that said first decoder should ignore the second encoded data, wherein the first encoded data is interleaved with the second encoded data with a start of a first frame of the first encoded data being provided before a start of a first frame of the second encoded data, with an end of the first frame of the first encoded data being provided after the start of the first frame of the second encoded data, with the start of the first frame of the second encoded data being provided before a start of a second frame of the first encoded data, and with an end of the first frame of the second encoded data being provided after the start of the second frame of the first encoded data, the audio encoding stream comprising:

a first encoding subsystem that generates the first encoded data;

a second encoding subsystem that generates the second encoded data; and a multiplexer that combines the first encoded data and the second encoded data to generate the unified bitstream.

10. The system of claim 9, wherein the first encoding subsystem is configured to encode audio data from a shared bitpool in accordance with the first encoding protocol, and the second encoding subsystem is configured to encode data from the shared bitpool in accordance with the second encoding protocol, and wherein the audio encoding system is configured to share available bits from the shared bitpool between the first encoding subsystem and the second encoding subsystem and to distribute the available bits from the shared bitpool between the first encoding subsystem and the second encoding subsystem in order to optimize overall audio quality of the unified bitstream.

11. The system of claim 9, wherein the first decoder is not configured to decode audio data encoded in accordance with the second encoding protocol, and the second decoder is not configured to decode audio data encoded in accordance with the first encoding protocol.

12. The system of claim 9, wherein the first encoding protocol is one of a Dolby Digital protocol, a Dolby Digital Plus protocol, an AAC protocol, a HE AAC v1 protocol, a HE AAC v2 protocol, and an object-oriented protocol.

13. The system of claim 9, wherein the second encoding protocol is one of a Dolby Digital protocol, a Dolby Digital Plus protocol, an AAC protocol, a HE AAC v1 protocol, a HE AAC v2 protocol, and an object-oriented protocol.

14. The system of claim 9, wherein the unified bitstream comprises hyperframes of encoded data encoded in accordance with the first encoding protocol and the second encoding protocol, wherein each of the hyperframes represents a time interval that is the same for the first encoding protocol and the second protocol, and consists of X frames of encoded audio data encoded in accordance with the first encoding protocol, multiplexed with Y frames of encoded audio data encoded in accordance with the second encoding protocol, such that said each of the hyperframes includes X+Y frames of encoded audio data.

15. An audio encoding method, for:

generating a single, unified bitstream that is decodable by a first decoder configured to decode audio data encoded in accordance with a first encoding protocol, and by a second decoder configured to decode audio data encoded in accordance with a second encoding protocol;

wherein the unified bitstream includes first encoded data decodable by the first decoder, and second encoded data decodable by the second decoder, and wherein the unified bitstream includes bits indicative to the second decoder that said second decoder should ignore the first encoded data and bits indicative to the first decoder that said first decoder should ignore the second encoded data; the method comprising generating the first encoded data by encoding audio data in accordance with the first encoding protocol;

generating the second encoded data by encoding audio data in accordance with the second encoding protocol; and generating the unified bitstream by multiplexing the first encoded data with the second encoded data such that the first encoded data is interleaved with the second encoded data with a start of a first frame of the first encoded data being provided before a start of a first frame of the second encoded data, with an end of the first frame of the first encoded data being provided after the start of the first frame of the second encoded data, with the start of the first frame of the second encoded data being provided before a start of a second frame of the first encoded data, and with an end of the first frame of the second encoded data being provided after the start of the second frame of the first encoded data.

16. The method of claim 15, wherein the method is performed by an audio encoding system including a first encoding subsystem configured to encode audio data from a shared bitpool, and a second encoding subsystem configured to encode data from the shared bitpool, and wherein the audio encoding system is configured to share available bits from the shared bitpool between the first encoding subsystem and the second encoding subsystem and to distribute the available bits from the shared bitpool between the first encoding subsystem and the second encoding subsystem in order to optimize overall audio quality of the unified bitstream.

17. The method of claim 15, wherein the first decoder is not configured to decode audio data encoded in accordance with the second encoding protocol, and the second decoder is not configured to decode audio data encoded in accordance with the first encoding protocol.

18. The method of claim 15, wherein the first encoding protocol is one of a Dolby Digital protocol, a Dolby Digital Plus protocol, an AAC protocol, a HE AAC v1 protocol, a HE AAC v2 protocol, and an object-oriented protocol.

19. The method of claim 15, wherein the second encoding protocol is one of a Dolby Digital protocol, a Dolby Digital Plus protocol, an AAC protocol, a HE AAC v1 protocol, a HE AAC v2 protocol, and an object-oriented protocol.

20. The method of claim 15, wherein the unified bitstream comprises hyperframes of encoded data encoded in accordance with the first encoding protocol and the second encoding protocol, wherein each of the hyperframes represents a time interval that is the same for the first encoding protocol and the second protocol, and consists of X frames of encoded audio data encoded in accordance with the first encoding protocol, multiplexed with Y frames of encoded audio data encoded in accordance with the second encoding protocol, such that said each of the hyperframes includes X+Y frames of encoded audio data.

* * * * *